US006644873B2

(12) United States Patent
Kurashina

(10) Patent No.: US 6,644,873 B2
(45) Date of Patent: Nov. 11, 2003

(54) PRINTING APPARATUS AND PRINTING METHOD

(75) Inventor: Hiroyasu Kurashina, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 92 days.

(21) Appl. No.: 10/007,685

(22) Filed: Dec. 4, 2001

(65) Prior Publication Data

US 2002/0085080 A1 Jul. 4, 2002

(30) Foreign Application Priority Data

Dec. 14, 2000 (JP) ..... 2000-380359

(51) Int. Cl.[7] ..... B41J 5/30

(52) U.S. Cl. ..... 400/61; 400/65; 400/76; 400/621; 358/1.2; 358/1.11

(58) Field of Search ..... 400/61, 65, 70, 400/76, 615.2, 78; 399/15; 347/40; 358/1.11, 1.2

(56) References Cited

U.S. PATENT DOCUMENTS

| | | | | | |
|---|---|---|---|---|---|
| 4,656,602 | A | * | 4/1987 | Berkland et al. | 400/78 |
| 5,647,676 | A | * | 7/1997 | Ito et al. | 400/65 |
| 5,902,051 | A | * | 5/1999 | Watanabe et al. | 400/61 |
| 6,019,453 | A | * | 2/2000 | Tsuruoka | 347/40 |
| 6,064,802 | A | * | 5/2000 | Watanabe et al. | 358/1.11 |
| 6,106,170 | A | * | 8/2000 | Watanabe et al. | 400/61 |
| 6,181,432 | B1 | * | 1/2001 | Furuya | 358/1.11 |
| 6,292,635 | B1 | * | 9/2001 | Tokairin et al. | 399/15 |
| 6,498,659 | B1 | * | 12/2002 | Konishi | 400/615.2 |
| 6,505,980 | B1 | * | 1/2003 | Allday | 400/61 |

* cited by examiner

*Primary Examiner*—Eugene H. Eickholt
(74) *Attorney, Agent, or Firm*—Hogan & Hartson, LLP

(57) ABSTRACT

There are provided a printing apparatus and a printing method which are capable of setting the print line width on a tape such that the widths of the print lines are adapted to the ruled line spacing defined by a predetermined standard, as well as discriminating and printing only designated data on a group-by-group basis. The printing apparatus is capable of printing characters of a desired size on a print medium while feeding the print medium contained therein. A print line width is set such that the print line width is adapted to a ruled line spacing defined by a predetermined standard. The characters are printed in the set print line width.

18 Claims, 19 Drawing Sheets

FIG. 10A

MENU OPTIONS FOR GROUP PROCESSING (OPTIONS DISPLAYED ON D12 IN FIG. 4)

| | PROCESSING |
|---|---|
| ENTER | ENTER DATA FOR REGISTRATION OF A GROUP |
| REVISE | REVISE ENTERED DATA |
| PRINT | PRINT LIST OF DATA |
| DELETE | DELETE ENTERED DATA |
| COPY | COPY DATA TO ANOTHER GROUP |

FIG. 10B

DATA ENTERED TO GROUP No. 02 (G02)

GROUP NAME: ROOM3 LIST

| ENTRY | DATA1 | DATA2 | DATA3 |
|---|---|---|---|
| 01 | Yamada Taro | Volleyball Club | PR Committee |
| 02 | | | |
| 03 | Motoki Yoshinori | Baseball Club | |
| 04 | Nagashima Masaki | Tennis Club | Sports Committee |
| 05 | Kiyohara Shinichi | | |
| 06 | Kawai Toshihisa | Swimming Club | |
| 07 | | | |
| 08 | Nioka Daisuke | Flower Arrangement Club | Library Committee |
| 09 | Nishi Shigeo | Photo Club | Library Committee |
| ⋮ | ⋮ | ⋮ | ⋮ |

FIG. 10C

MENU OPUTIONS FOR SELECTING CORRESPONDING SHEET SIZES (OPTIONS DISPLAYED ON D44 IN FIG. 9)

| SIZE(JIS) | (SIZE) | LNGTH×WDTH (mm) |
|---|---|---|
| 1 | A4 | 297×210 |
| 3 | A5 | 210×148 |
| 4 | B6 | 182×128 |
| 5 | A6 | 148×105 |
| 6 | Semi B5 | 252×179 |

FIG. 10D

MENU OPTIONS FOR SELECTING CORRESPONDING RULED LINE SPACING (OPTIONS DISPLAYED ON D45 IN FIG. 9)

| (RULED LINE SPACING) | RULED LINES (JIS) |
|---|---|
| 7 mm | A |
| 6 mm | B |
| 5 mm | C |
| 8 mm | |
| 10 mm | |

| | NAME | Committee |
|---|---|---|
| 01 | Yamada Taro | PR Committee |
| 04 | Nagashima Masaki | Sports Committee |
| 08 | Nioka Daisuke | Library Committee |
| 09 | Nishi Shigeo | Library Committee |

PORTRAIT/HORIZONTAL WRITING

LANDSCAPE/VERTICAL WRITING

PORTRAIT/VERTICAL WRITING

LANDSCAPE/HORIZONTAL WRITING

PRINTING APPARATUS AND PRINTING METHOD

BACKGROUND OF THE INVENTION

1. Field of the Invention

This invention relates to a printing apparatus and a printing method which are capable of printing characters of a desired size on a print medium while feeding the print medium contained therein.

2. Prior Art

Conventionally, printing apparatuses are widely known which print characters of desired sizes on a print medium, such as a tape, for producing labels. In these printing apparatuses, when characters in horizontal writing in which characters are arranged in horizontal or lateral rows as in ordinary alphabetical writing are printed such that the direction of length of each character string is parallel to the direction of feed of the tape, the size of printable characters and the number of rows of characters corresponding to the size of printable characters are predetermined according to the width of the tape. Therefore, naturally, if the size of characters is increased, the number of printable rows of the characters is reduced, whereas if the size of characters is decreased, the number of printable rows of the characters is increased. That is, each print line width depends on the width of the tape and the size of characters.

Now, as shown in FIG. 19, tapes produced by the above printing apparatuses are sometimes affixed to paper, such as notebook paper or the like, which is provided with ruled lines at intervals of a space (hereinafter referred to as "ruled line spacing") defined by a predetermined standard. In such a case, however, the print line width on the tape and the ruled line spacing on the notebook are rarely coincident with each other, resulting in the degraded appearance of the page bearing the tape, and further, for instance, when the user desires to enter notes in association with data printed on the tape, he often has to write characters across the ruled lines, which makes it difficult to add the notes to the page.

To eliminate the above inconveniences, an attempt can be made to cause the print line width on the tape to coincide with the ruled line spacing of the ruled lines on the notebook. However, the print line width depends on the tape width and the size of characters, as described above. Therefore, this necessitates a troublesome and time-consuming work of calculating back an appropriate tape width and character size from the ruled line spacing of the notebook. Moreover, actually, it is required to allow for a margin (interlinear spacing defined as a spacing between adjacent concatenations of character bodies in a direction perpendicular to a direction of extension of character strings), and hence it is very difficult to cause the print line width on the tape to coincide with the ruled line spacing of the notebook.

SUMMARY OF THE INVENTION

It is an object of the invention to provide a printing apparatus and a printing method which are capable of setting a print line width on a tape such that the print line width is adapted to the ruled line spacing defined by a predetermined standard.

To attain the above object, according to a first aspect of the invention, there is provided a printing apparatus which is capable of printing characters of a desired size on a print medium while feeding the print medium contained therein.

The printing apparatus according to the first aspect of the invention is characterized by comprising:

print line width-setting means for setting a print line width such that the print line width is adapted to a ruled line spacing defined by a predetermined standard; and printing means for printing the characters in the print line width set by the print line width-setting means.

To attain the above object, according to a second aspect of the invention, there is provided a printing method of printing characters of a desired size, comprising the steps of:

setting a print line width such that the print line width is adapted to a ruled line spacing defined by a predetermined standard; and printing the characters in the set print line width.

According to these printing apparatus and printing method, it is possible to set the print line width on a print medium in a manner adapting the print line width to a ruled line spacing defined by the predetermined standard so as to print the characters within the print line width set by the print line width-setting means. Therefore, for instance, when the print medium printed with the characters is affixed to a ruled sheet of a notebook, the print line width of the print medium and the ruled line spacing of the ruled sheet match each other, thereby making it possible to cause the resulting ruled sheet to have an attractive appearance. Also when notes or memos are entered to comment on contents printed on the print medium, the characters can be prevented from being written across the ruled lines on the notebook since the print line width on the print medium and the ruled line spacing on his notebook match each other. This enables the user to make the contents of the notebook orderly and attractive.

It should be noted that the term "print line width" is used throughout the specification and appended claims to represent a width occupied or to be occupied by a line of characters printed or to be printed on a print medium. It is not required that the line is actually printed on the print medium. The term "ruled line spacing" is used throughout the specification and appended claims to mean a distance from one ruled line to the next, in other words, a width or height of a section defined by a pair of ruled lines adjacent to each other. Further, the term "ruled line spacing defined by the predetermined standard" is used to mean any of various ruled line spacings, such as "7 mm for Ruled lines A (ordinary horizontal ruled line)", "6 mm for Ruled lines B (medium horizontal ruled line)", and "5 mm for Ruled lines C (thin horizontal ruled line)" defined by Japanese Industrial Standards (JIS) as well as ruled line spacings defined by the organization standard of "Japanese Paper Product Industry Association". Further, when there are standards on Ruled lines defined by the government of a country or a corporation, ruled line spacings defined by the standards as well are included in the category of the above "ruled line spacing defined by the predetermined standard".

Preferably, the print line width-setting means includes means for setting the print line width not by designating a numerical value but by designating a type of the ruled line spacing defined by the predetermined standard.

Preferably, the step of setting a print line width includes the step of setting the print line width not by designating a numerical value but by designating a type of the ruled line spacing defined by the predetermined standard.

According to these preferred embodiments, the print line width is set not by designating a numerical value but by designating a type of ruled line spacing defined by the predetermined standard. More specifically, the print line width can be set not by designating a numerical value, such as "7 mm" or "6 mm", but by designating a type of ruled line spacing, such as "Ruled lines A (ordinary horizontal ruled line)" and "Ruled lines B (medium horizontal ruled line)" in JIS, and hence when it is desired to cause the print line width of the print medium to match the ruled line spacing of the "Ruled lines A", the print line width can be set with ease even if the size of the ruled line spacing of the "Ruled lines A" is unknown to the user.

Preferably, the print line width-setting means includes means for designating a size of one print line width as an integral multiple of one ruled line spacing defined by the predetermined standard.

Preferably, the step of setting a print line width includes the step of designating a size of one print line width as an integral multiple of one ruled line spacing defined by the predetermined standard.

According to these preferred embodiments, it is possible to set the size of a width of one print line to an integral multiple of one ruled line spacing defined by the predetermined standard. Therefore, for instance, when a large characters size is desired to be set, if a ruled line spacing three times as large as one ruled line spacing on a notebook is designated, one print line width on the print medium matches or corresponds to three ruled line spacings on the notebook, whereby the object article can have an attractive appearance after the print medium is affixed thereto.

Preferably, the printing apparatus further comprises printing direction-setting means for setting a direction of printing of the characters and a direction of length of print lines of the characters.

Preferably, the printing method further comprises the step of setting a direction of printing of the characters and a direction of length of print lines of the characters.

More preferably, the printing direction-setting means includes means for setting the direction of printing such that an upward direction with respect to the characters coincides with a direction of feed of the print medium, and at the same time the direction of length of print lines is orthogonal to the direction of feed of the print medium.

More preferably, the printing direction-setting means includes means for setting the direction of printing such that an upward direction with respect to the characters and the direction of length of print lines are orthogonal to the direction of feed of the print medium.

According to these preferred embodiments, it is possible to set the direction of printing of the characters and the direction of length of print lines of the characters. More specifically, when the character strings in horizontal writing are printed, the direction of printing the same is set such that an upward direction with respect to the characters coincides with the direction of feed of the print medium and a direction of length of the print lines is orthogonal to the direction of feed of the print medium, whereas when the character strings in vertical writing in which the characters are arranged in vertical rows or columns as in writing in the Japanese language are printed, the direction of printing the same is set such that the upward direction with respect to the characters and the direction of length of the print lines are orthogonal to the direction of feed of the print medium, whereby if the print medium is not limited in size in the direction of feed thereof, the number of lines of the character strings can be increased unlimitedly. Therefore, by changing the direction of printing of characters in accordance with print images and the number of lines to be printed, it is possible to form a print having a size desired by the user, whereby the versatility of the printing apparatus is enhanced.

Preferably, the printing apparatus further comprises character size designation means for designating a size of one character.

According to this preferred embodiment, since the size of characters can be designated, it is possible to create a visually impactful print e.g. by emphasizing part of a print image by large character sizes as desired.

Preferably, assuming that straight lines with reference to which the character strings are arranged in a direction of length of print lines and which extend in parallel with the direction of length of print lines are defined as reference lines, with a distance between adjacent ones of the reference lines being represented by a and the ruled line spacing defined by the predetermined standard being represented b, the character size designation means includes means for designating the size of the character such that a value of $a \times m$ (m is an integer equal to or larger than 1) and a value of $b \times n$ (n is an integer equal to or larger than 1) are equal to each other.

According to this preferred embodiment, assuming that straight lines with reference to which the character strings are arranged in a direction of length of print lines and which extend in parallel with the direction of length of print lines are defined as reference lines, it is possible to designate the size of the character such that the value of $a \times m$ and the value of $b \times n$ are equal to each other. Accordingly, for instance, if the distance a between the reference lines is equal to 3 mm, and the size b of the one ruled line spacing is equal to 7 mm, the common multiples of the distance a and the size b are 21, 42, . . . . In the case of 21 as one of the values thus obtained, for instance, (the case in which the product of $a \times m$ and that of $b \times n$ are equal to 21), the value of m and the value of n are equal to 7 and 3, respectively. This means that it is possible to designate a character size such that seven rows of character strings can be printed within the three ruled line spacings. Inversely, if two rows of character strings are designated to be printed within the five ruled line spacings with the one ruled line spacing being equal to 7 mm, it is possible to designate a character size such that the distance a between the reference lines is equal to 17.5 mm ($a=b \times 5/2$). In short, it is possible to minimize mismatching between the ruled line spacing and the print line width as well as freely set the size of characters, thereby enhancing the appearance of an article to which the print is affixed.

It should be noted that in the above case, it is preferred that the character size is determined such that the characters are laid out with appropriate space (interlinear spacing defined as a spacing between adjacent concatenations of character bodies in a direction perpendicular to a direction of extension of character strings) with respect to the distance a between the reference lines. This configuration makes it possible to eliminate inconveniences e.g. that it becomes difficult to read letters when they are printed with narrow interlinear spacing.

More preferably, assuming that either a vertical size or a lateral size of the character designated by the character size designation means is k times (k is a number truncated to an integer) as large as the ruled line spacing defined by the predetermined standard, the print line width-setting means includes means for setting a number of lines occupied by the characters to (k+1).

According to this preferred embodiment, when the vertical size or lateral size of one character designated by the character size designation means is k times as large as the ruled line spacing defined by the predetermined standard, it is possible to set the number of print lines occupied by characters to (k+1). Now, let it be assumed, for instance, that the size of the characters in horizontal writing is designated to be point size 20 with the vertical size thereof being 13 mm, and that the character size is adjusted to the "Ruled lines A (7 mm)". In this case, the vertical size 13 mm of the characters is 1.857 . . . times as large as the size 7 mm of the one ruled line spacing, and hence an integer "2" which is obtained by adding 1 to an integer 1 to which the number 1.857 . . . is truncated by dropping the fractional portion of the number below the decimal point, is set to the number of print lines to be occupied by the characters. In short, the characters can be printed within an integral multiple of one ruled line spacing, to whatever size the characters may be set, and hence it is possible to affix the print to an article without deviation from alignment (mismatching), whereby the article having the print affixed thereto has an attractive appearance.

Further, in the above case, it is preferred that the difference 1 mm obtained by subtracting the vertical size 13 mm of the characters from the size 14 mm of the two ruled line spacings is allocated to upper and lower portions of interlinear spacing such that the upper and lower portions have an equal width of 0.5 mm. According to this configuration, the article having the print affixed thereto can have a more attractive appearance.

Preferably, the printing apparatus further comprises storage means for storing a plurality of character data converted from the characters and storing grouping data for classifying the plurality of character data into at least one group, and group selection means for selecting one group from the at least one group, and the printing means prints characters corresponding to the plurality of character data belonging to the one group selected by the group selection means.

According to this preferred embodiment, the printing apparatus stores a plurality of character data converted from the characters and grouping data for classifying the plurality of character data into at least one group. Further, the printing apparatus selects one group from the at least one group to print characters corresponding to the plurality of character data belonging to the one group. Therefore, for instance, when the personal names of students belonging to several classes are stored as character data, and the names of the classes are stored as grouping data in a manner correlated with the character data, if one of the classes is designated, the personal names of the students of the class are printed. That is, since the character data are grouped, it is possible to designate only a necessary group to print only character data belonging to the group.

It should be noted that the term "grouping data" indicates data required for grouping character data, such as character data stored in groups, and "identifiers" for classifying character data into groups which are used in cases where different "identifiers" indicative of respective groups are added to individual character data for classification of the individual character data into the groups.

Preferably, the printing apparatus further comprises printing order-changing means for changing an order of printing of the plurality of character data according to a predetermined order rule, and the printing means prints characters according to the order of printing changed by the printing order-changing means.

According to this preferred embodiment, it is possible to change the order of printing of the plurality of character data according to the predetermined order rule to print characters according to the changed order rule. Therefore, when the plurality of character data are indicative of the names of students, and the predetermined order rule is "alphabetical order", the names of the plurality of students can be re-arranged in "alphabetical order" for printing. In short, the plurality of character data stored at random can be printed in the order desired by the user.

It should be note that the term "predetermined order rule" is used herein to mean "rule for determining a sequence of items entered as character data based on a certain element of each item", such as the above "alphabetical order" as well as "order of birth dates", "order of scored marks (e.g. as a result of an examination)", etc. depending on details of character data.

More preferably, the storage means further includes means for storing discriminative data for discriminating between the plurality of character data in a manner correlating the discriminative data with each of the character data, and the printing means determines for each of the character data whether or not characters corresponding thereto should be printed, depending on details of or presence or absence of the discriminative data correlated with each of the character data.

According to this preferred embodiment, it is possible to store discriminative data for discriminating between the plurality of character data in a manner correlating the discriminative data with each of the character data items, and determine as to each character data whether or not corresponding characters should be printed, depending on details of or presence or absence of the discriminative data correlated with the character data. Accordingly, for instance, assuming that the plurality of character data are data of the names of students, and the discriminative data for discriminating between the character data are the names of classes, it is possible to determine, for instance, whether or not discriminative data correlated with the data of the name of each student is "Class A", and print the name of a student only when the discriminative data correlated with the data of the name of the student is "Class A". In short, it is possible to discriminate between character data items for printing.

Further, for instance, assuming that the plurality of character data are data of the names of students, and the discriminative data is data indicative whether or not each student belongs to a sports club (e.g. data of "1" set when an student belongs to any of the sports clubs, and data of "0" or "absence of the discriminative data" set when he does not belong to any of the sports clubs), it is possible to print e.g. the names of students on condition that the discriminative data correlated to the data of the name of each student is "0" indicating that the student does not belong to any of the sports clubs or the discriminative data is absent. This means that it is possible to extract and print only character data having contents desired by the user.

Further preferably, the printing apparatus further comprises input means capable of inputting at least one of the character data, the grouping data and the discriminative data, and the data input by the input means are stored in the storage means.

According to this preferred embodiment, at least one of the character data, the grouping data, and the discriminative data can be entered for storage. Therefore, it is possible to input, for instance, the names of the user's friends as the character data, the names of schools as the grouping data correlated with each of the character data items (names of the user's friends), and symbols only for boy students as the discriminative data. Further, the above entered data can be stored in the printing apparatus. In short, character data, grouping data, and discriminative data can be input and stored according to the user's needs.

Preferably, the printing means includes means for printing the plurality of character data in a list form.

According to this preferred embodiment, plurality of character data can be confirmed rapidly since they can be printed in a list.

Preferably, the print medium is formed by an image-receiving layer serving as a printing surface, an adhesive layer formed on a side reverse thereto, and a peel layer formed on the adhesive layer, the print medium being affixable to an object article by peeling off the image-receiving layer and the adhesive layer from the peel layer.

According to this preferred embodiment, the print medium is formed by an image-receiving layer serving as a printing surface, an adhesive layer formed on a reverse side thereof, and a peel layer formed on the reverse side of the adhesive layer, so that a produced print (image-receiving layer) can be affixed to the object article with ease simply by peeling off the image-receiving layer and the adhesive layer from the peel layer.

More preferably, the printing apparatus further comprises cutting means for cutting off the print medium to a desired size, and object article size-designating means for designating a size of the object article to which the print medium is affixed, and the cutting means cuts off the print medium to a size permitting the print medium to be affixed to the size designated by the object article size-designating means.

According to this preferred embodiment, it is possible to cut off the print medium to a size permitting the print medium to be affixed to the object article of the designated size. Therefore, for instance, assuming that the size of the object article is designated to Size 1 (A4: vertical size 297 mm×lateral size 210 mm), it is possible to cut off the print medium to a size (e.g. vertical size 280 mm×lateral size 190 mm) smaller than the Size 1. This means that the print medium can be cut off such that it can be received within the object article.

It should be noted that when the size of the object article is designated, only one of the vertical and lateral sizes thereof may be designated. Further, the size of the object article may be designated to sizes, such as "Size 1 (A4)", "Size 3 (A5)" and so forth, as defined by JIS or any other standard, or alternatively the vertical and lateral lengths of the object article may be designated by directly inputting numerical values thereof respectively.

More preferably, the print medium is made of a material having high transparency.

According to this preferred embodiment, the print medium is made of a material having high transparency, so that when the print medium is affixed to the object article, the ruled lines on the object article can be seen through the print medium. This makes it possible to make use of the ruled lines as they are. Further, if a transparent and colorless print medium is employed, is possible to make the affixed print medium inconspicuous.

Preferably, the print medium is a tape-shaped member.

According to this preferred embodiment, since the print medium is a tape-shaped member, it can be used in the tape printing apparatus, and convenient in producing labels and the like. Further, if a roll of the tape-shaped member is contained in the printing apparatus, the apparatus can be made compact in construction.

The above and other objects, features, and advantages of the invention will become more apparent from the following detailed description taken in conjunction with the accompanying drawings.

BRIEF DESCRIPTION OF THE DRAWINGS

FIG. 10A is a diagram showing a list enumerating menu options for selection in group processing;

FIG. 10B is a diagram showing data entered to "G02";

FIG. 10C is a diagram showing a list enumerating menu options for selecting corresponding sizes;

FIG. 10D is a diagram showing a list enumerating menu options for selecting corresponding ruled line spacings;

DETAILED DESCRIPTION OF PREFERRED EMBODIMENT

The invention will now be described in detail with reference to the drawings showing an embodiment thereof. In the embodiment, a printing apparatus and a printing method according to the invention are applied to a tape printing apparatus.

Figure 1:
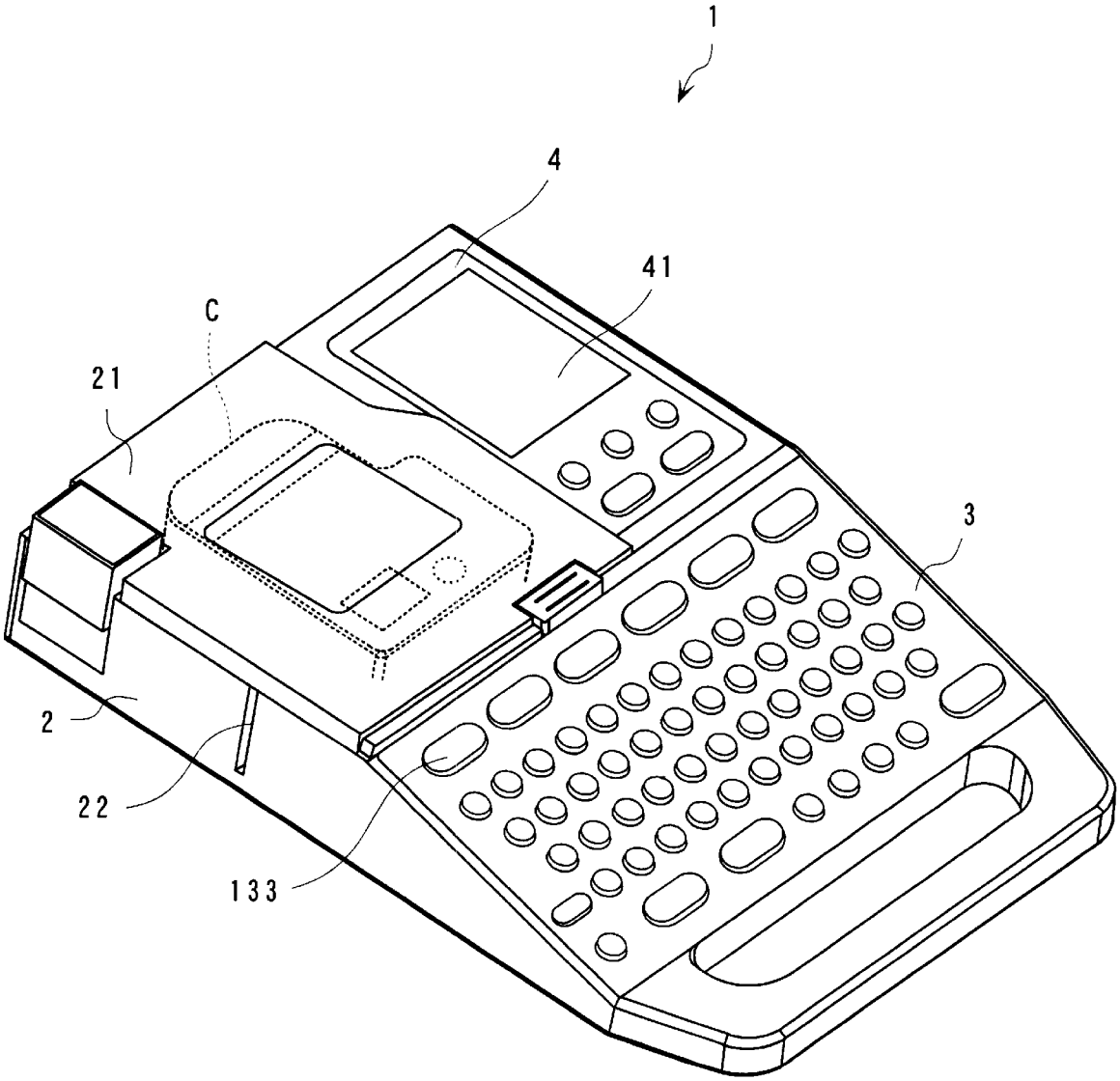
FIG. 1 is a perspective view of the appearance of a tape printing apparatus to which are applied a printing apparatus and a printing method according to an embodiment of the present invention.
Figure 2:
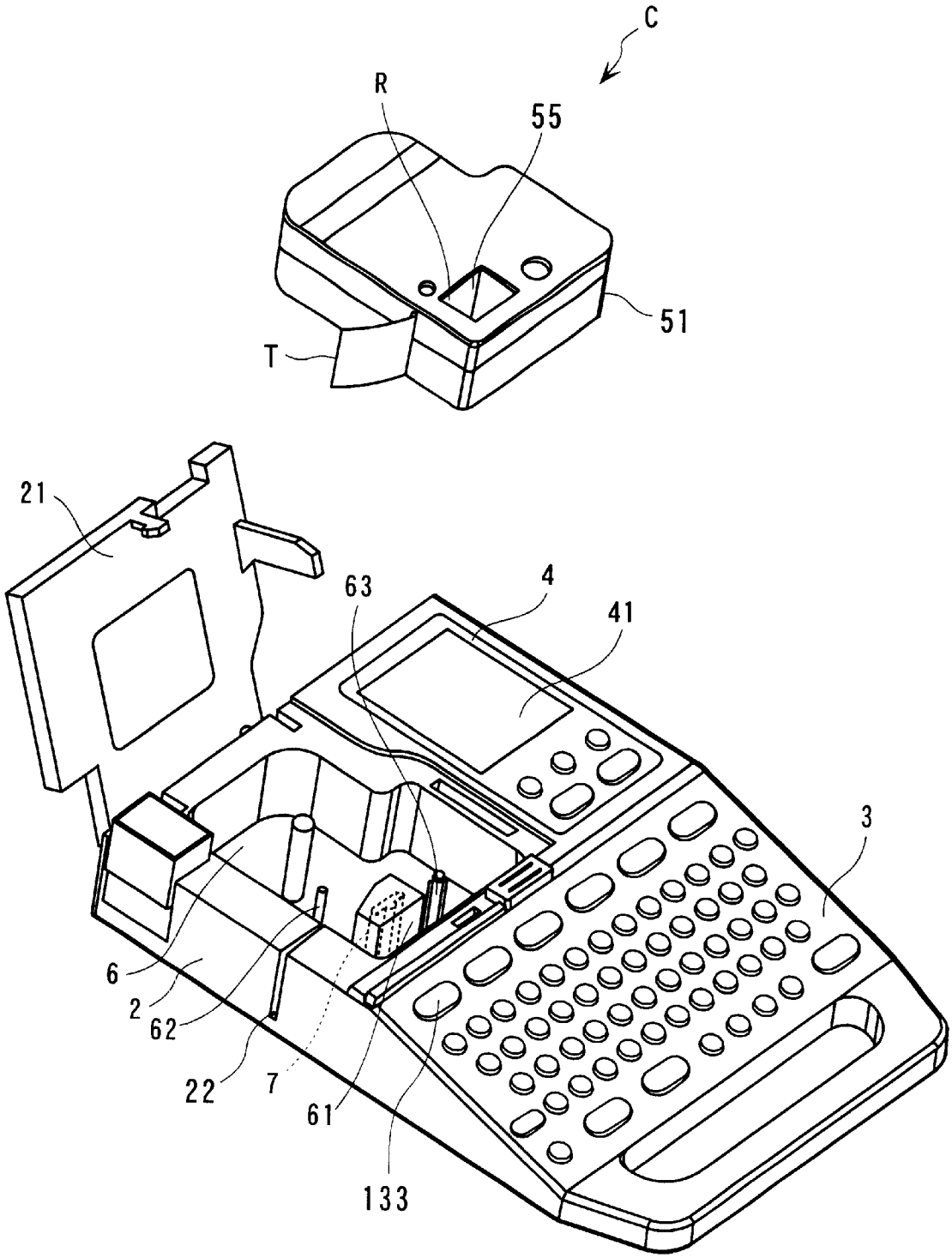
FIG. 2 is a perspective view of the appearance of the FIG. 1 tape printing apparatus with a lid thereof being open.
Figure 3:
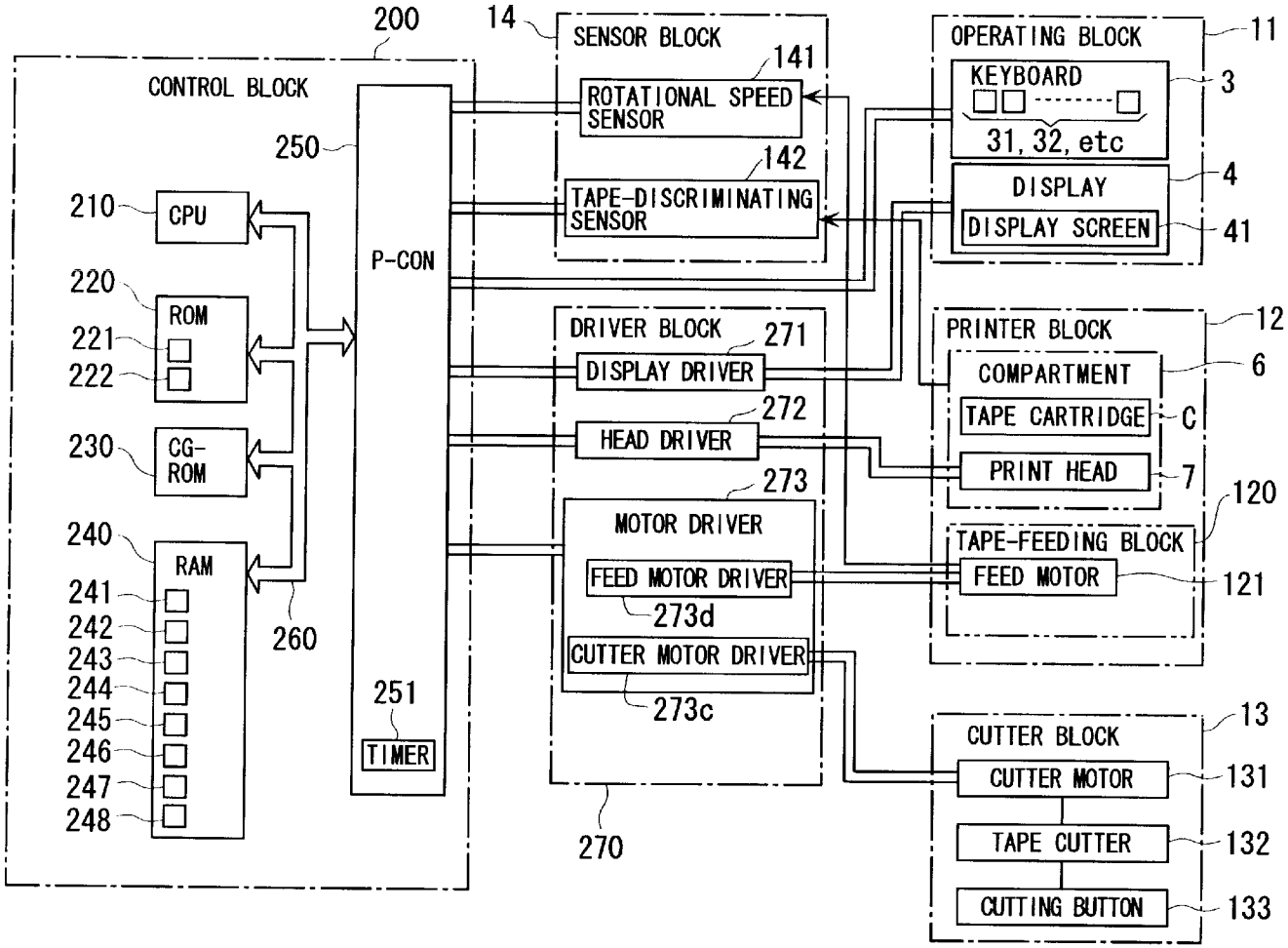
FIG. 3 is a block diagram schematically showing a control system of the FIG. 1 tape printing apparatus.

FIG. 1 is a perspective view of the appearance of the whole tape printing apparatus according to the present embodiment, and FIG. 2 is a perspective view of the appearance of the FIG. 1 tape printing apparatus with its lid being open and a tape cartridge being removed therefrom. FIG. 3 is a block diagram schematically showing a control system of the FIG. 1 tape printing apparatus. As shown in FIGS. 1 and 2, the tape printing apparatus 1 includes an apparatus casing 2 having upper and lower divisional portions which form the outer shell of the apparatus 1. Arranged on the top of the front portion of the apparatus casing 2 is a keyboard 3 which is comprised of various kinds of input keys. Further, the apparatus casing 2 has a lid 21 and a display 4 arranged on the left-hand side and the right-hand side of the top of the rear portion thereof, respectively.

Further, as shown in FIG. 3, the tape printing apparatus 1 is basically comprised of an operating block 11 having the keyboard 3 and the display 4 for interfacing with the user, a printer block 12 having a print head (thermal head) 7 and a tape feeder block 120 for printing on a printing tape (hereinafter simply referred to as "the tape") T unwound from a tape cartridge C mounted in a compartment 6, a cutter block 13 for cutting off a printed portion of the tape T, a sensor block 14 having various sensors for carrying out various detecting operations, a driver block 270 having drivers for driving circuits of devices of the apparatus 1, and a control block 200 for controlling operations of blocks and devices of the apparatus 1 including the above-mentioned sensors and drivers. To implement the above construction, the apparatus casing 2 accommodates a circuit board, not shown, in addition to the printer block 12, the cutter block 13, the sensor block 14 and so forth. On the circuit board are mounted a power supply unit and the circuits of the driver block 270 and the control block 200, which are connected to a connector port, not shown, for connecting an AC adapter thereto, and batteries, such as nicad batteries, which can be removably mounted within the apparatus casing 2 from outside.

In the tape printing apparatus 1, after mounting the tape cartridge C in the compartment 6, the user enters printing information, such as desired characters (letters, numerals, symbols, simple figures, etc.) via the keyboard 3, while confirming or viewing the results of the entry or edit of the printing information on the display 4. Thereafter, when the user instructs the apparatus 1 to perform a printing operation via the keyboard 3, the tape feeder block 120 unwinds a tape T from the tape cartridge C, and the print head 7 prints on the tape T. The printed portion of the tape T is delivered from a tape exit 22 as the printing proceeds. When the desired printing operation is completed, the tape feeder block 120 sends the tape T to a position corresponding to an end of a tape length (the length of a label to be formed) including the length of margins, and then stops the feeding of the tape.

As shown in FIGS. 2 and 3, the printer block 12 has the compartment 6 arranged under the lid 21 for mounting the tape cartridge C therein. The tape cartridge C can be mounted in or removed from the compartment 6 when the lid 21 is open. The tape cartridge C has a cartridge casing 51 holding a tape T having a predetermined width (approximately 4.5 to 48 mm) and an ink ribbon R. The tape cartridge C is formed with a through hole 55 for receiving therein a head unit 61 arranged in the compartment 6. Further, the tape cartridge C has a plurality of small holes formed in the bottom thereof for discrimination of a type of the tape T contained therein from the other types of the tape T having different widths, which are contained in other types of tape cartridges C. The compartment 6 has a tape-discriminating sensor 142 comprised of micro-switches or the like, for detecting the above holes to thereby determine the type of the tape T set for use.

Figure 11A:
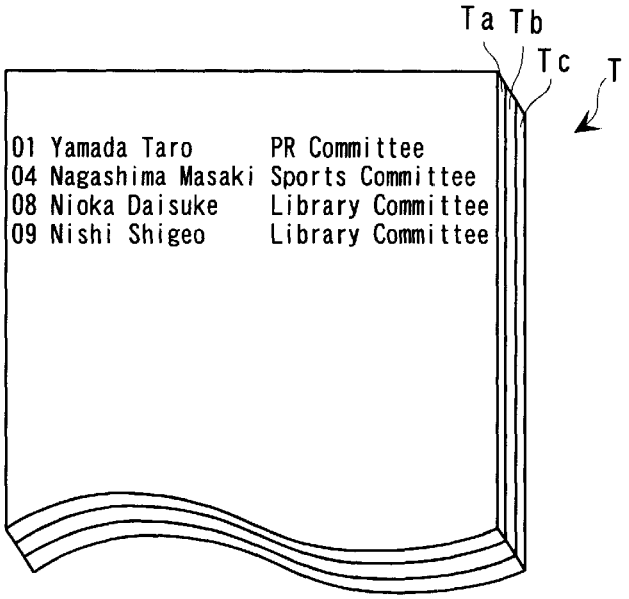
FIGS. 11A to 11C are diagrams showing examples of the print obtained by the processes shown in FIGS. 7 to 9.
Figure 11B:
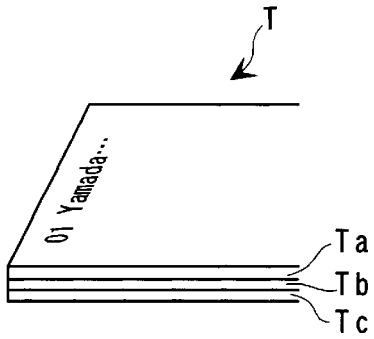

The tape T is comprised of an image-receiving layer Ta which serves as a printing surface, an adhesive layer Tb formed on the reverse side thereof, and a peel layer Tc formed on the reverse side of the adhesive layer Tb (see FIGS. 11A and 11B). The tape T and the ink ribbon R are fed or run such that they pass by the through hole 55, in a state lying one upon the other, and the tape T alone is delivered out of the tape cartridge C, but the ink ribbon R is taken up into a roll within the tape cartridge C. The tape T delivered from the tape exit 22 has the adhesive layer Tb peeled off to be affixed to an object article.

The head unit 61 contains the print head 7 formed of a thermal head. The print head 7 is brought into contact with the reverse side of the ink ribbon R exposed to the through hole 55 of the tape cartridge C when the tape cartridge C is mounted in the compartment 6 with the print head 7 fitted in the through hole 55. Then, by driving the print head 7 while heating the same, desired letters and the like are printed on the surface of the tape T. Further, the apparatus casing 2 has a left side portion thereof formed with the tape exit 22 such that the compartment 6 and the outside of the apparatus communicate with each other. Opposed to the tape exit 22, there is arranged a tape cutter 132 for cutting off a dispensed portion of the tape T.

Further, the compartment 6 is provided with drive shafts 62, 63 for engagement with driven portions of the tape cartridge 4 mounted in the compartment 6. A feed motor 121 as a drive source drives these drive shafts 62, 63 for rotation to feed or advance the tape T and the ink ribbon R in the tape cartridge C, and at the same time the print head 7 is driven in synchronism with the feeding of the tape and ribbon to carry out printing. Further, after completion of the printing operation, the tape T continues to be fed to bring a predetermined cutting position (corresponding to the tape length) on the tape T to the position of the tape cutter 132.

It should be noted that the feed motor 121 has an end on which is rigidly fitted a disc, not shown, formed with detection openings, and a rotational speed sensor 141 including a photo sensor or the like is provided to face the path of the detection openings, for sending information of the rotational speed of the feed motor 121 detected thereby to the control block 200.

The cutter block 13 includes a tape cutter 132, a cutting button 133 for being manually operated to cause the tape cutter 132 to cut the tape T when a desired length printing is carried out, for instance, and a cutter motor 131 for automatically driving the tape cutter 132 to cut the tape T when a fixed length printing is carried out, for instance. To selectively carry out one of the two cutting operations, the tape printing apparatus 1 is capable of being switched between a manual cutting mode and an automatic cutting mode according to a mode-setting operation. More specifically, in the manual cutting mode, when the printing operation is completed, the user pushes the cutting button 133 arranged on the apparatus casing 2, whereby the tape cutter 132 is actuated to cut the tape T to a desired length. On the other hand, in the automatic cutting mode, after completion of the printing operation, the tape T is sent for incremental feed by the length of a rear margin, and then stopped, whereupon the cutter motor 131 is driven to cut the tape T.

The tape cutter 132 is comprised of two kinds of tape cutters 132, that is, a tape cutter 132 for cutting through the tape T (performing through-cutting of the tape T)and a tape cutter 132 for cutting only the image-receiving layer (performing half-cutting of the tape T). Only one of the tape cutters 132 is driven as required.

The sensor block 14 includes the rotational speed sensor 141, the tape-discriminating sensor 142. It should be noted that the above sensors can be omitted to suit the actual requirements of the tape printing apparatus.

The driver block 270 includes a display driver 271, a head driver 272, and a motor driver 273. The display driver 271 drives the display 4 of the operating block 11 in response to control signals delivered from the control block 200, i.e. in accordance with commands carried by the signals. Similarly, the head driver 272 drives the print head 7 of the printer block 12 in accordance with commands from the control block 200. Further, the motor driver 273 includes a feed motor driver 273*d* for driving the feed motor 121 of the printer block 12, and a cutter motor driver 273*c* for driving the cutter motor 131 of the cutter block 13, and similarly to the display driver 271 and the head driver 272, drives each motor in accordance with commands from the control block 200.

The operating block 11 includes the keyboard 3 and the display 4. The display 4 has a display screen 41 which is capable of displaying display image data of 96 by 64 dots on a rectangular display area of approximately 6 cm in the horizontal direction (X direction) by 4 cm in the vertical direction (Y direction). The display 4 is used by the user when he enters data via the keyboard 3 to form or edit print image data, such as character string image data, and check the result of the entry, or enters instructions or commands via the keyboard 3.

On the keyboard 3, there are arranged a character key group 31 including an alphabet key group, a symbol key group, a number key group, and a nonstandard character key group for calling nonstandard characters for selection, as well as a function key group 32 for designating various operation modes. In a type of the apparatus which is capable of inputting the Japanese language, the character key group 31 also includes a kana key group for inputting Japanese hiragana letters and Japanese katakana letters.

The function key group 32 includes a "group" key for instructing the registration, printing and modification of grouping data formed by classifying character data into groups, a "printing execution" key for instructing execution of a printing operation. The function key group 32 further includes a "selection" key for selecting options displayed on the display screen 41 during kana-kanji conversion (in the case of a Japanese language-adapted type of the apparatus) or selection of other functions, a "deletion" key for deleting a letter at a cursor position and canceling the operation of an activated one of functions, and "cursor" keys (up arrow key, down arrow key, right arrow key, and left arrow key) for moving a cursor K representing a position where a character is to be input next or a position where an operation is to be carried out.

Of course, similarly to keyboards of the general type, the above-mentioned key entries may be made by the respective keys exclusively provided therefor or by a smaller number of keys operated in combination with the shift key and/or the like. As shown in FIG. 3, by using the keyboard 3, various commands and data are input to the control block 200.

The control block 200 includes a CPU 210, a ROM 220, a character generator ROM (CG-ROM) 230, a RAM 240, a peripheral control circuit (P-CON) 250, all of which are connected to each other by an internal bus 260. The ROM 220 has a control program area 221 for storing control programs executed by the CPU 210 as well as a control data area 222 for storing control data including a character list table, grouped character data (grouping data), a color conversion table, and a character modification table. The CG-ROM 230 stores bit map data, i.e. data defining symbols, figures and the like, provided for the tape printing apparatus 1. When code data for specifying a character or the like is input thereto, it outputs the corresponding bit map data.

The RAM (storage device) 240 is supplied with power by a backup circuit, not shown, such that stored data can be preserved even after the power is turned off by operating the power key. The RAM 240 includes areas of a register group 241, a character data area 242 for storing character data of letters or the like input by the user via the keyboard 3, a grouping data area 243 for storing registered grouping data, a display image data area 244 for storing image data displayed on the display screen 41, a print image data area 245 for storing print image data, a registered image data area 246 for storing registered image data, as well as a print record data area 247 and conversion buffer areas 248 including a color conversion buffer. The RAM 240 is used as a work area for carrying out the control process.

The P-CON 250 incorporates a logic circuit for complementing the functions of the CPU 210 as well as dealing with interface signals for interfacing between the CPU 210 and peripheral circuits. The logic circuit is implemented by gate arrays, a custom LSI and the like. For instance, a timer 251 is also incorporated in the P-CON 250 for the function of measuring elapsed time. To perform its functions, the P-CON 250 is connected to the sensors of the sensor block 14 and the keyboard 3, for receiving the above-mentioned signals generated by the sensor block 14 as well as commands and data input via the keyboard 3, and inputting these to the internal bus 260 directly or after processing them. Further, the P-CON 250 cooperates with the CPU 210 to output data and control signals input to the internal bus 260 by the CPU 210 or the like, to the driver block 270 directly or after processing them.

The CPU 210 of the control block 200 receives the signals from the sensor block 14, and the commands and data input via the keyboard 3 via the P-CON 250, according to the control program read from the ROM 220, processes bit map data from the CG-ROM 230 and various data stored in the RAM 240, and delivers control signals to the driver block 270 via the P-CON 250 to thereby carry out position control during printing operations, display control of the display screen 41, and printing control of the print head 7 to carry out printing on the tape T under predetermined printing conditions. In short, the CPU 210 controls the overall operation of the tape printing apparatus 1.

Now, the printing method applied to the tape printing apparatus 1 will be described. As described above, in the tape printing apparatus 1 according to the present invention, the print line width of characters printed on the tape T is set in a manner adjusted to a ruled line spacing defined by a predetermined standard, and characters of desired sizes are printed on the tape T based on the set or determined print line width. Now, the printing method according to the present invention will be described by following an example of a procedure of operations with reference to images displayed on the screen 41 shown in FIGS. 4 to 9.

Figure 4:
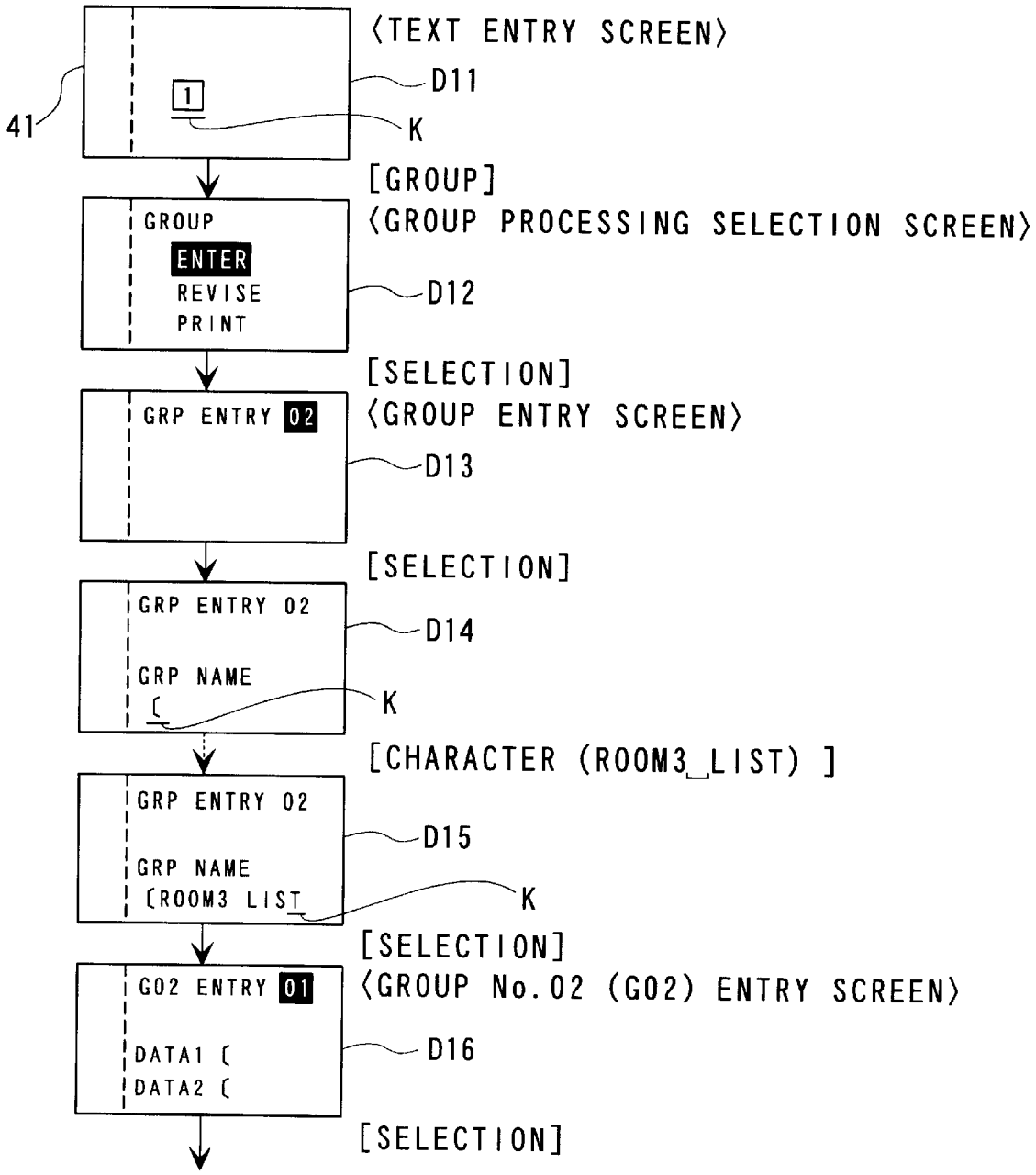
FIG. 4 is a diagram schematically illustrating images displayed on a display screen, which is useful in explaining an example of a process of entry of grouping data.

As shown in FIG. 4, when the power of the tape printing apparatus 1 is turned on, first, a text entry screen is displayed (D11). On the text entry screen are displayed a numeral 1 in a square box, which indicates that entry of characters is for a first row or first line, and the cursor K. In the illustrated example, since the cursor K is placed under the numeral 1 in the square box, a character will be displayed at a location next and to the right of the numeral 1 when it is input.

Now, when the group key is depressed by the user, the screen is switched to a group processing selection screen (D12). In the illustrated example, not only letters "GROUP" indicating that the group key has been depressed but also letters "ENTER", "REVISE" and "PRINT" are displayed as options among which the option "ENTER" is displayed in reverse video by default (indicating an option accessed on the immediately preceding occasion). To select the default value, the user depresses the selection key in the illustrated state (in the state of the option displayed in reverse video).

To select another option, the user depresses the cursor key or the like. On the screen 41, options are displayed in half-tone dot meshing one after another in accordance with each depression of the cursor key, and an option is selected when the user depresses the selection key in the state of the option displayed in half-tone dot meshing (processing of the option is carried out). [An option is selected by carrying out similar key operations, and hence hereinafter, description of such key operations is omitted and they are simply referred to as "select" or "depress the selection key"). In the illustrated example, since the option "ENTER" is selected, the cursor key or the like is not depressed but the selection key is depressed in the state shown in the figure.

It should be noted that on the group processing selection screen (D12), options "DELETE" and "COPY" can be selected in addition to the options "ENTER", "REVISE" and "PRINT" shown in the figure. Processing carried out by selecting each of the options is as shown in FIG. 10A, and description thereof is omitted.

On the group processing selection screen (D12), when the option "ENTER" is selected, the screen is switched to a group entry screen (D13). On the group entry screen (D13), letters "GRP ENTRY" (group entry) are displayed which represent that processing for entering (registering) a group is to be executed, together with a number "02" in a square box representative of a group number being displayed in reverse video. This implies that a group number "01" has already been registered, and that the minimum value of entry numbers which can be registered (entered) next is the number "02" shown in the square box. Here, let it be assumed that the selection key is depressed by the user to register data to a group having the group number 02 (hereinafter referred to as the "G02").

Now, if the data is desired to be entered by the user not to the "G02" but to another group, the user is only required to shift the numeral displayed in reverse video from "02" to "03", "04" . . . sequentially by depressing the cursor key in the illustrated state of the "D13", and depress the selection key when a desired group number is displayed in reverse video.

After a group number is specified, the screen 41 is switched to a screen for inputting a group name (D14). In the illustrated example, letters "GRP NAME" (group name) are displayed, and the cursor K is placed under a bracket "[". At this position of the cursor K, the group name is input by operating keys on the keyboard 3, and the cursor K is moved in accordance with the input of the group name. In the illustrated example, the group name "ROOM3 LIST" is input (D15), and the selection key is depressed, whereby the screen is switched to a G02 entry screen (D16).

On the G02 entry screen, there are displayed letters "G02 ENTRY" representing that the G02 is to be registered (entered) and in a manner continued therefrom, a number "01" in a square box representing an entry number is displayed in reverse video. This indicates that it is possible to register a entry number "01" in the group number "02". In the illustrated example, to register the entry number "01", the selection key is depressed by the user. Although three data items, DATA 1 to DATA 3 can be entered on the G02 entry screen, in the illustrated example, only "DATA 1 [" and "DATA 2 [" representing that DATA 1 and DATA 2 are to be entered are displayed ("DATA 3 [" is not displayed at this time].

Figure 5:
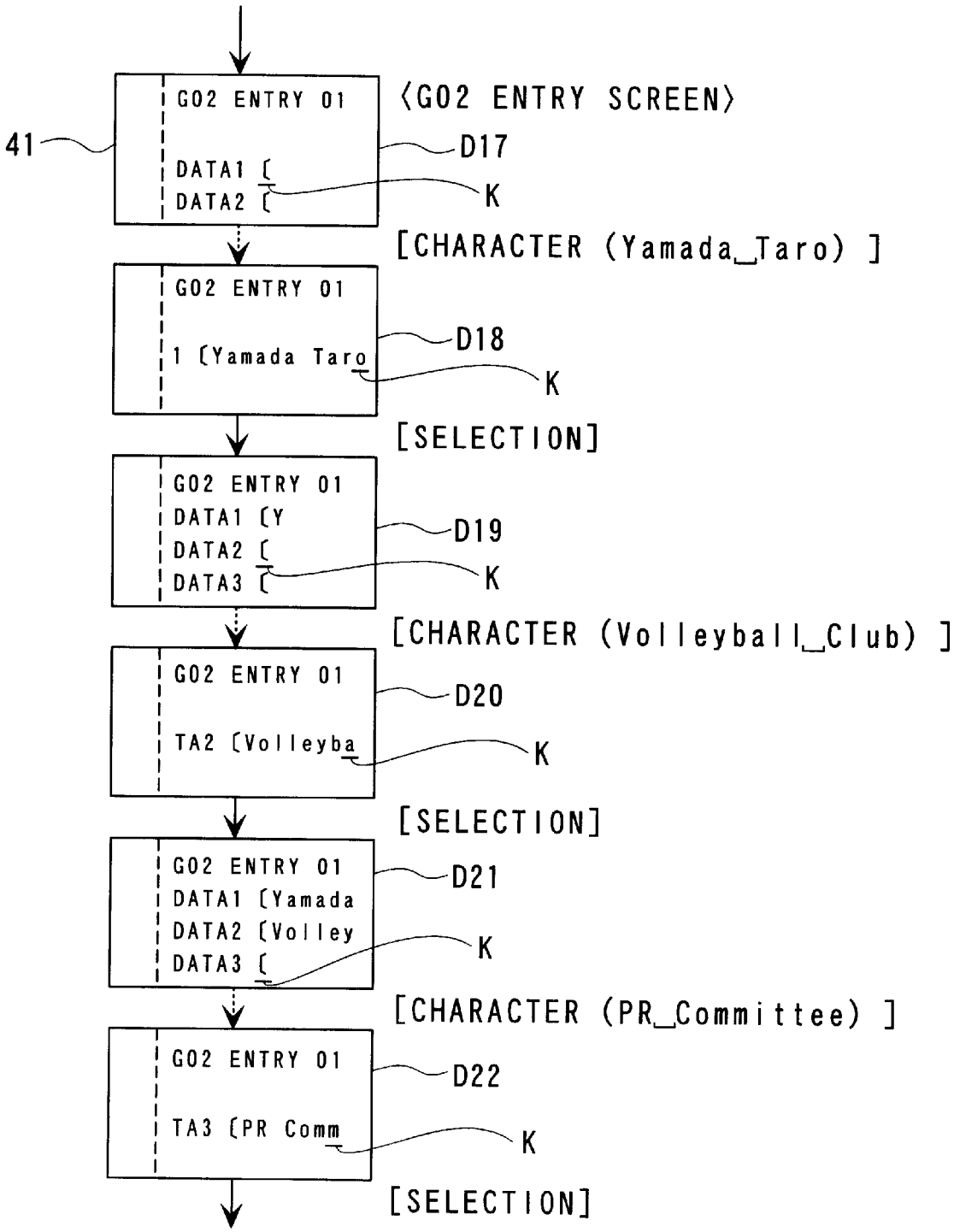
FIG. 5 is a continuation of FIG. 4.

On the G02 entry screen (D16), when the selection key is depressed by the user, as shown in FIG. 5, the number "01" having been displayed in reverse video is normally displayed, and the cursor K is placed under the bracket "[" of "DATA 1 [". This shows that "DATA 1" can be input. It should be noted that in this state, the cursor key (down arrow key, right arrow key or conversion key) is depressed to move the cursor to a location under the bracket of desired one of the three data items, whereby it is also possible to start to input data not from "DATA 1" but from "DATA 2" or "DATA 3".

In the illustrated example, letters (personal name) "Yamada Taro" are entered as "DATA 1" (D18). After completion of the entry, the selection key is depressed, and then the user is prompted to input "DATA 2" (D19). As "DATA 2", there is entered the name of a club to which a person whose name has been input to "DATA 1" belongs. In this example, the name "Volleyball Club" is entered (D20). Similarly, when the selection key is depressed, the user is prompted to input "DATA 3" (D21), and the name of a committee to which the person whose name was input to "DATA 1" belongs is input. In this example, the name "PR Committee" is entered (D22).

It should be noted that data do not have to be entered to all of DATA 1 to DATA 3. More specifically, if the person "Yamada Taro" does not belong to any club, the filed of "DATA 2" may remain blank. Further, the number of enterable data items may be increased instead of being limited to DATA 1 to DATA 3. This configuration enables the user to manage more detailed information, such as an address, and a telephone number, of each person and use the information as items to be printed.

Figure 6:
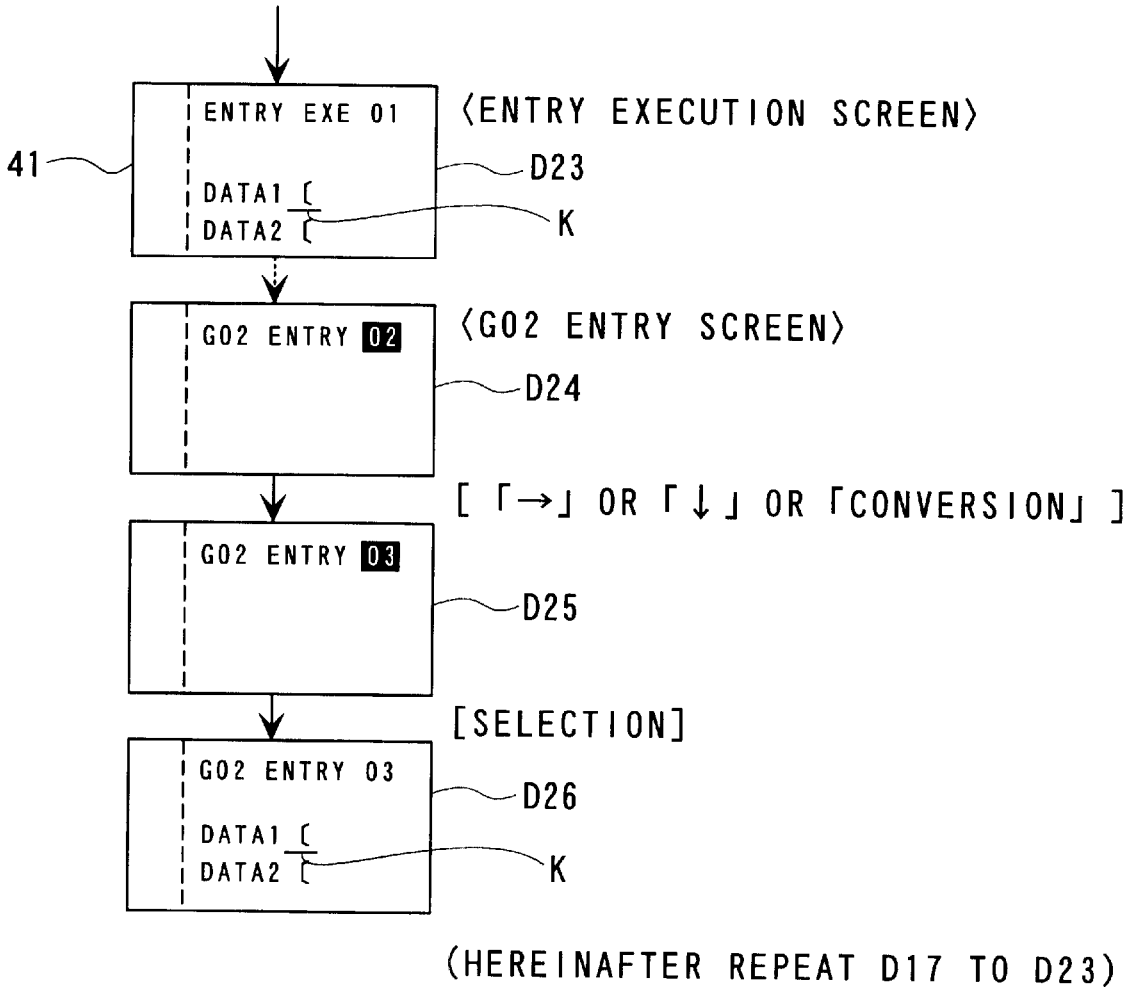
FIG. 6 is a continuation of FIG. 5.

After the entry of DATA 1 to DATA 3 has been completed, when the selection key is depressed, as shown in FIG. 6, the screen is switched to an entry execution screen (D23) on which are displayed letters "ENTRY EXE" (entry execution) representing that registration is being executed, and further a number "01" indicating that the entry number "01" is entered (registered). When approximately 0.75 seconds have elapsed after being switched to this screen (entry execution screen), the screen 41 is switched to a display screen of the G02 entry screen with an entry number 02 (D24).

On this G02 entry screen, similarly to the screen 41 shown in FIG. 4 (D16), a number "02" in a square box representing an entry number is displayed in reverse video after the letters "G02 ENTRY". In the illustrated example, no entry is made to the entry number "02" (see FIG. 10B), and the cursor key (down arrow key, right arrow key or conversion key) is depressed once by the user, and then the selection key is depressed in the state of a number "03" in a square box being displayed in reverse video (D25). Then, the screen 41 is switched to a screen which prompts the user to enter "DATA 1" for the entry number "03" (D26), similarly to the screen 41 shown in FIG. 5 (D17), and then DATA 1 to DATA 3 are input. After that, the operations on the G02 entry screen (D17) to the entry execution screen (D23) are repeatedly carried out several times, whereby the entry of a plurality of grouping data is made to the "G02". Part of the entered grouping data items is as shown in FIG. 10B.

It should be noted that the number of letters which can be input to the DATA 1 to DATA 3 may be limited (up to 20 letters in em size (full size) in each of the DATA 1 to DATA 3). This configuration makes it possible to specify the capacity of a built-in memory (grouping data area 243) for storing data to some extent.

Further, the apparatus may be configured such that not the built-in memory but an external storage device can be connected to the apparatus to cause the device to store the registered data such that the stored data can be read therefrom as required. This configuration makes it possible to limit the capacity of the built-in memory to a required minimum.

Figure 7:
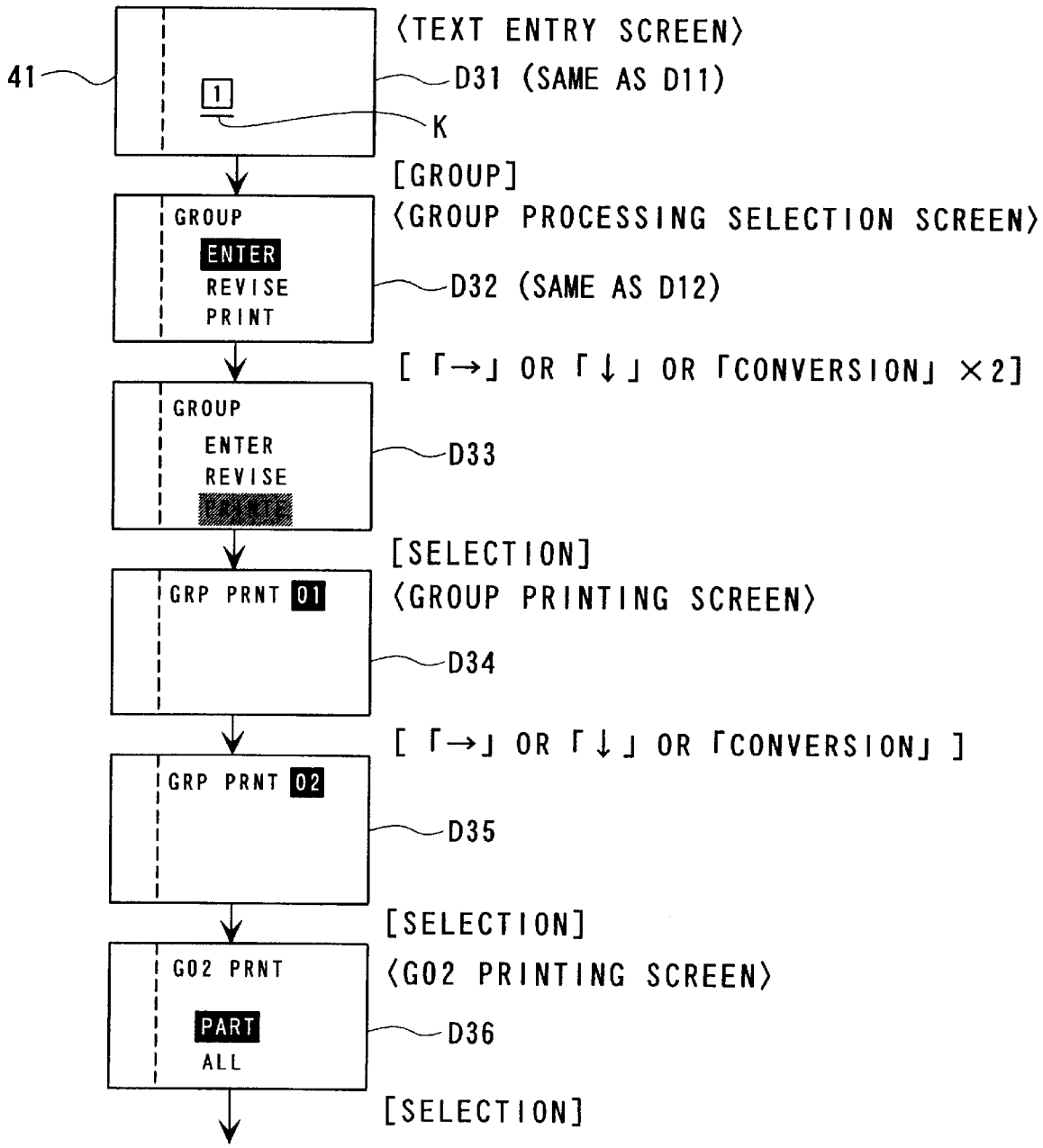
FIG. 7 is a diagram schematically illustrating images displayed on a display screen, which is useful in explaining an example of a process of calling grouping data and a process of executing group printing.

Next, how the registered data are called and printed will be described with reference to FIGS. 7 to 9. Now, the description will be given assuming that a print shown in FIG. 11A is produced. Referring to FIG. 7, on the text entry screen (D31: the same as the D11 in FIG. 4), when the group key is depressed, the screen is switched to the group processing selection screen (D32: the same as the D12 in FIG. 4). Here, when the cursor key (down arrow key, right arrow key or conversion key) is depressed twice, the option "PRINT" is displayed in half-tone dot meshing (D33), and when the selection key is depressed, the screen is switched to a group printing screen (D34).

On the group printing screen (D34), letters "GRP PRNT" (group printing) indicating that group printing is to be carried out are displayed, together with a number "01" in a square box being displayed in reverse video to indicate that the group printing is conducted on the data registered under the group number "01". In the illustrated example, in order to print the data entered to the "G02" through the above operations (see FIGS. 4 to 6), the cursor key (down arrow key, right arrow key or conversion key) is depressed once to thereby display the number "02" in reverse video, which indicates that data of the group number "02" is to be printed.

Now, when the selection key is depressed, the screen is switched to a G02 printing screen (D36) on which letters "G02 PRNT" (G02 printing) indicating that the data entered to the "G02" is to be printed are displayed together with options represented by letters "PART" and "ALL". The option "PART" is for printing any one or two data items of DATA 1 to DATA 3, whereas the option "ALL" is for printing all the data entered (DATA 1 to DATA 3). In the illustrated example, since printing of "DATA 1" and "DATA 3" is carried out, the selection key is depressed in the state of the option "PART" set by default being displayed in reverse video.

Figure 8:
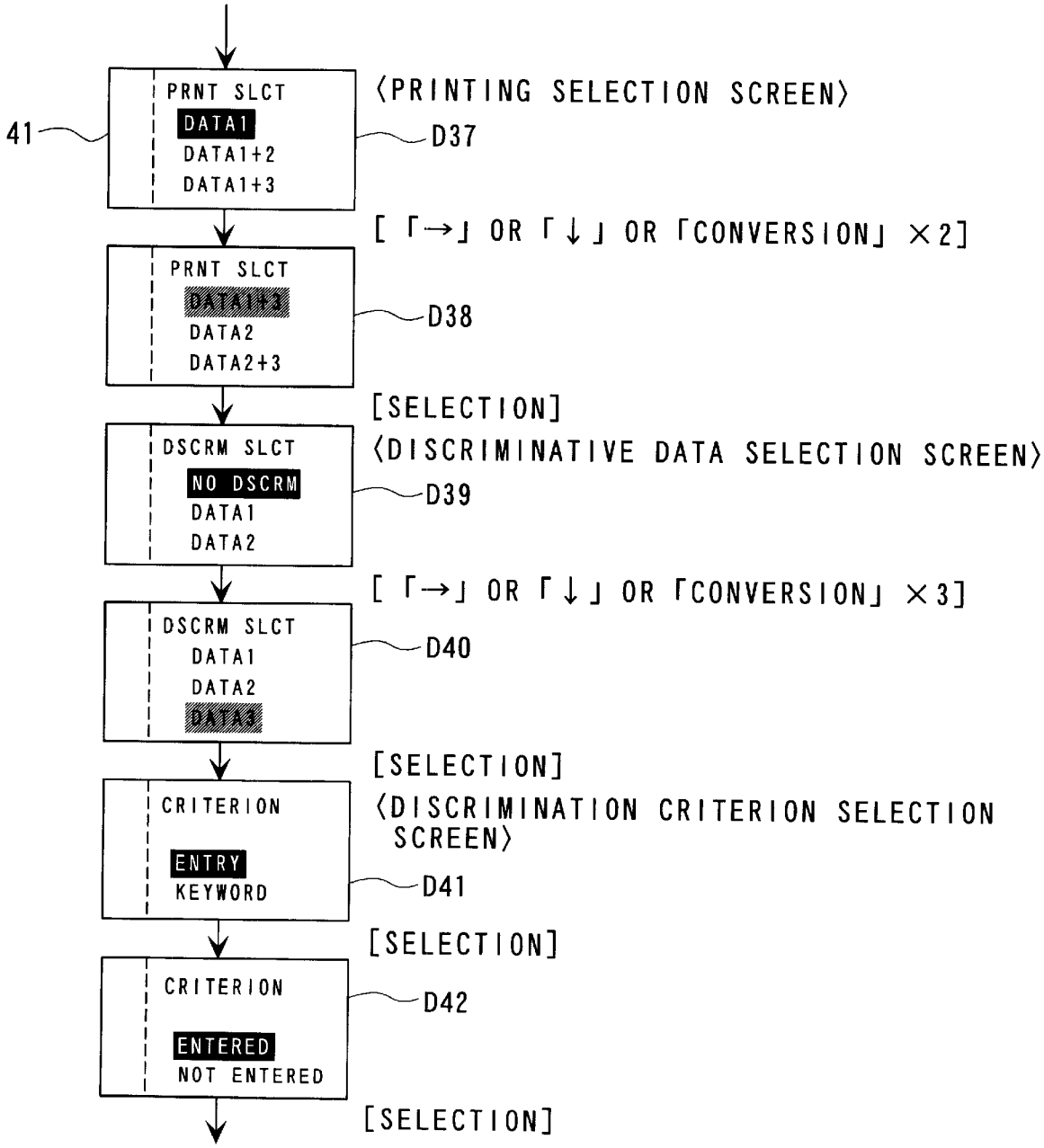
FIG. 8 is a continuation of FIG. 7.

Then, as shown in FIG. 8, the screen is switched to a printing selection screen (D37) on which data or a combination of data for printing is selected. In the illustrated example, it is possible to select from not only "DATA1", "DATA1+2", and "DATA1+3" displayed on the screen (D37) but also "DATA2", "DATA2+3" and "DATA3". It should be noted that combinations of the data items arranged in the reversed print order, such as "DATA2+1", "DATA3+2" and the like may be added to the above options.

In the illustrated example, the cursor key (down arrow key, right arrow key or conversion key) is depressed twice from the state (D37) of "DATA 1" set by default being displayed in reverse video, and the selection key is depressed in the state of "DATA1+3" being displayed in half-tone dot meshing (D38). It should be noted that if the option "ALL" is selected on the G02 printing screen" (D36 in FIG. 7), the screen is not switched to the printing selection screen (D37 or D38) but directly switched to a discriminative data selection screen (D39), referred to hereinafter.

When the screen 41 is switched from the printing selection screen (D38) to the discriminative data selection screen (D39) on which letters "DSCRM SLCT" (discriminative data selection) indicating that this screen is for selecting data with reference to which discrimination between character data should be carried out are displayed together with options "NO DSCRM" (no discriminative data), "DATA1", and "DATA2" ("DATA3" is not displayed at this time). The option "NO DSCRM" is for printing all the designated data ("DATA1" and "DATA3) without carrying out discrimination of data. In the illustrated example, it is desired to discriminate only persons belonging to committees from the rest and print the names of them (entry of "DATA 3" indicates a committee to which each person belongs), and hence the cursor key (down arrow key, right arrow key or conversion key) is depressed three times from the state of the option "NO DSCRM" set by default being displayed in reverse video, and the selection key is depressed in the state of "DATA3" being displayed in half-tone dot meshing (D40).

Then, the screen 41 is switched to a discrimination criterion selection screen on which letters "CRITERION" (discrimination criterion selection) indicating that the screen 41 is for selecting a criterion applied to the discriminative data are displayed together with options "ENTRY" (whether entry of the data exists or not) and "KEYWORD" are displayed (D41). The option "ENTRY" is provided to discriminate data (determine whether or not the data should be printed) depending on whether or not the data entry exists, and the "KEYWORD" is provided to discriminate data (determine whether or not the data should be printed) depending on whether or not the data contains a keyword designated by the user. In the illustrated example, it is desired to discriminate only persons belonging to the committees (i.e. only character data with entry of "DATA 3") from the rest for printing, and hence the selection key is depressed in the state of the option "ENTRY" set by default being displayed in reverse video.

Then, the screen 41 is switched to a selection screen (D42) for selecting which of the character data with entry of "DATA3" and the character data without entry of "DATA3" should be printed. In the illustrated example, in order to discriminate or select only persons belonging to committees (i.e. only persons with entry of "DATA 3"), the selection key is depressed in the state of the option "ENTERED" set by default being displayed in reverse video. It should be noted that the above data discrimination process may be carried out on the same screen without dividing the selection screen into two (D41 and D42) at different hierarchical levels (in other words, on the same screen of D41, there may be displayed the three options of "ENTERED", "NOT ENTERED" and "KEYWORD").

Figure 9:
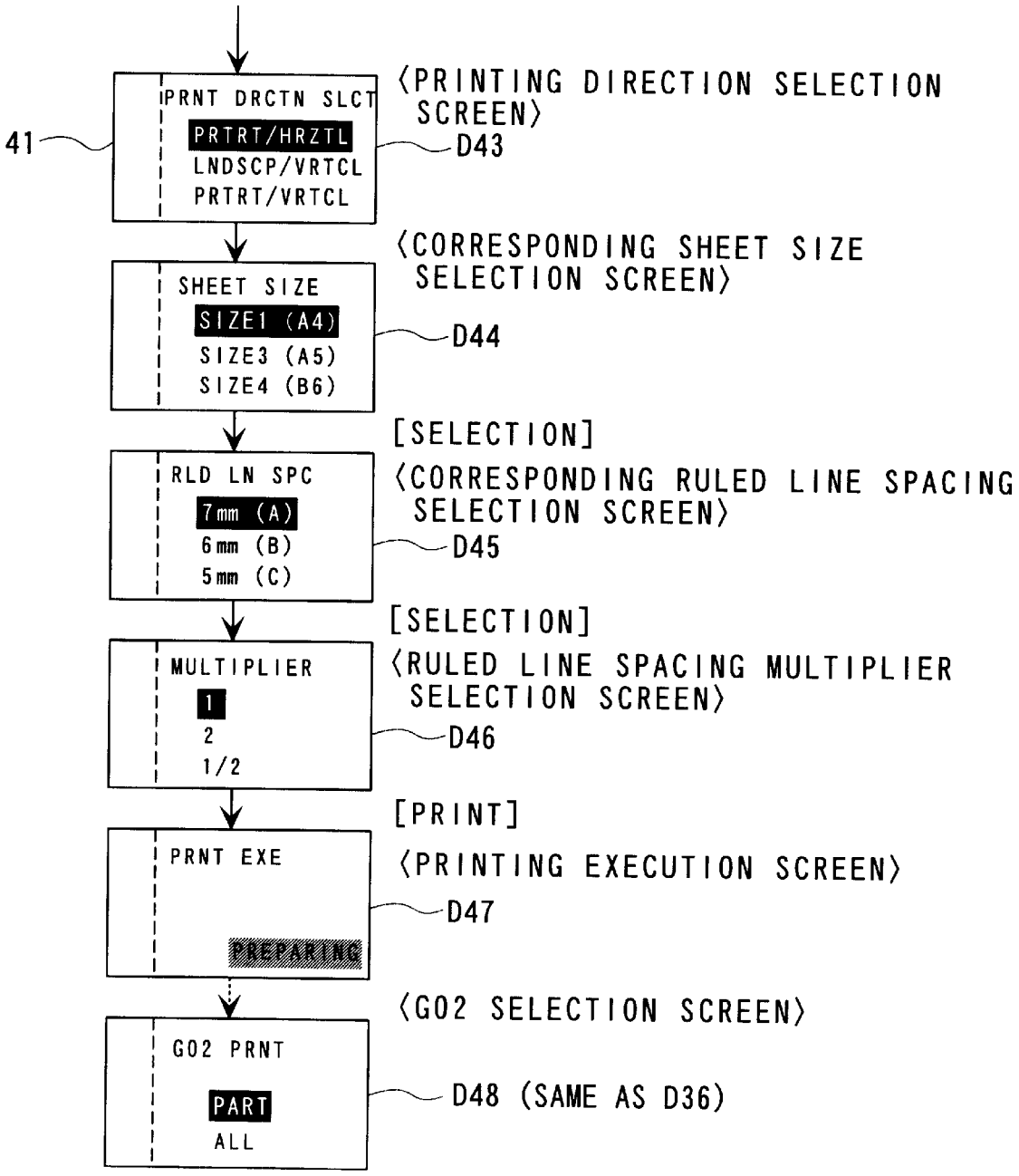
FIG. 9 is a continuation of FIG. 8.

Then, as shown in FIG. 9, when the screen is switched to a printing direction selection screen, letters "PRNT DRCTN SLCT" (printing direction selection) indicating that the screen 41 is a selection screen (D43) for selecting the direction of printing are displayed, together with options "PRTRT/HRZTL" ("portrait/horizontal writing"), "LNDSCP/VRTCL" ("landscape/vertical writing") and "PRTRT/VRTCL" ("portrait/vertical writing"). Although an option "LNDSCP/HRZTL" ("landscape/horizontal writing") can be also selected on this screen (D43), this option is not displayed at this stage).

Figure 17A:
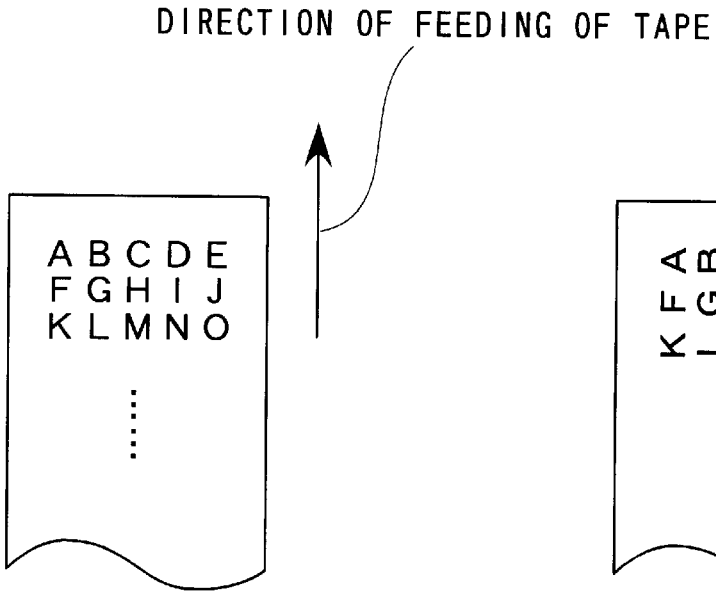
FIGS. 17A to 17D are diagrams showing selectable directions of printing, together with prints obtained by the respective selected directions of printing.
Figure 17B:
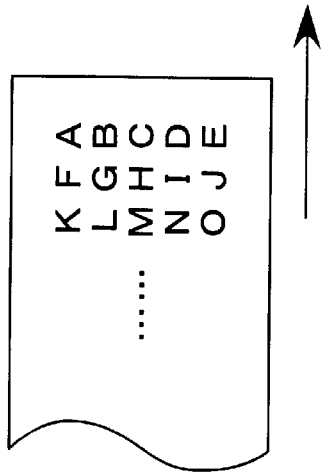
Figure 17C:
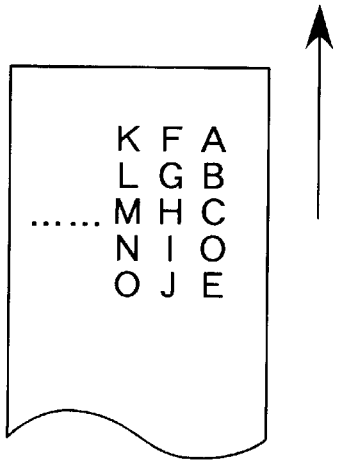
Figure 17D:
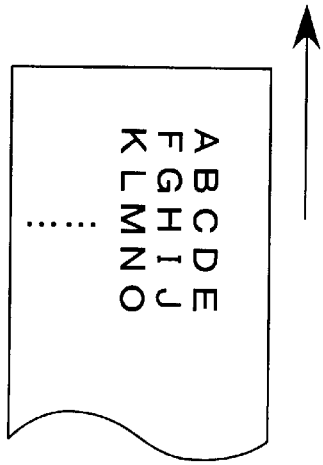

Examples of prints obtained by selecting the respective options are as shown in FIGS. 17A to 17D. In printing operations, referred to hereinafter, in the case of "portrait/horizontal writing" shown in FIG. 17A and "landscape/vertical writing" shown FIG. 17B, the print line width is set to lines extending in a direction orthogonal to the direction of feed of the tape T, while in the case of "portrait/vertical writing" shown in FIG. 17C and "landscape/horizontal writing" shown in FIG. 17D, the print line width is set to lines extending in the same direction as the direction of feed of the tape T. Further, if the "portrait/horizontal writing" in FIG. 17A or the "landscape/vertical writing" in FIG. 17B is selected here, the number of lines can be unlimitedly increased since the length of the tape T in the direction of feed thereof is not limited. Therefore, it is preferred here to select a direction of printing of characters in accordance with a print image and the number of print lines.

In the illustrated example, on the printing direction selection screen (D43), the selection key is depressed in the state of the option "PRTRT/HRZTL" set by default being displayed in reverse video, whereby the screen is switched to a corresponding sheet size selection screen (D44). On this screen, letters "SHEET SIZE" indicating that the screen 41 is a selection screen for selecting the size of an object article N to which the tape T is to be affixed are displayed together with options of "SIZE1 (A4)", "SIZE3 (A5)", and "SIZE4 (B6)". Although in addition to the above options, options shown in FIG. 10C can be selected on this selection screen, they are not displayed at this stage.

It should be noted that the options for selecting corresponding sheet sizes to be displayed here are not limited to the above examples. Further, the options may be displayed only by size numbers or alternatively in combination with vertical and horizontal lengths. Further, on the printing direction selection screen (D43), when the option "PRTRT/HRZTL" (FIG. 17A) or the option "LNDSCP/VRTCL" (FIG. 17B) is selected, the length of a to-be-printed portion of the tape T is set to be several tens of millimeters shorter than a vertical length (LENGTH) shown in a FIG. 10C table, whereas when the option "PRTRT/VRTCL" (FIG. 17C) or the option "LNDSCP/HRZTL" (FIG. 17D) is selected, the length of a to-be-printed portion of the tape T is set to be several tens of millimeters shorter than a horizontal length (WIDTH) shown in the FIG. 10C table.

In the illustrated example, on the corresponding sheet size selection screen (D44), the selection key is depressed in a state of the option "SIZE1 (A4)" set by default being displayed in reverse video, whereby the screen 41 is switched to a corresponding ruled line spacing selection screen (D45). On this screen, letters "RLD LN SPC" (ruled line spacing) indicating that the screen 41 is a selection screen 41 for selecting the ruled line spacing on the object article N are displayed together with options "7 mm (A)" (7 mm spacing of Ruled lines A), "6 mm (B)" (6 mm spacing of Ruled lines B) and "5 mm (C)" (5 mm spacing of Ruled lines C). Although in addition to the above options, options shown in FIG. 10D can be selected on this selection screen, they are not displayed at this stage.

It should be noted that the options displayed on the corresponding ruled line spacing selection screen (D45) are not limited to the above examples. Further, the options may be displayed only by notations ("Ruled lines A", "Ruled lines B" and the like) defined by JIS or only by the ruled line spacing ("7 mm", "6 mm", etc.). Further, if the option "PRTRT/HRZTL" (FIG. 17A) or the option "LNDSCP/VRTCL" (FIG. 17B) has been selected on the printing direction selection screen (D43), the ruled line spacing corresponding to the print line width extending in the direction orthogonal to the direction of feed of the tape T is selected, whereas if the option "PRTRT/VRTCL" (FIG. 17C) or the option "LNDSCP/HRZTL" (FIG. 17D) has been selected on the same, the ruled line spacing corresponding to the print line width extending in the same direction as the direction of feed of the tape T is selected.

In the illustrated example, on the corresponding ruled line spacing selection screen (D45), the selection key is depressed by the user in the state of the option "7 mm (A)" set by default being displayed in reverse video, whereby the screen is switched to a ruled line spacing multiplier selection screen (D46). On this screen, letters "MULTIPLIER" are displayed for indicating that the screen 41 is a selection screen for selecting a multiplier by which the ruled line spacing selected on the screen (D45) is multiplied to set a print line width, together with options of 1, 2 and ½. Although in addition to the above options, options 3, ⅓, 4 and ¼ can be selected on the selection screen, they are not displayed at this stage. Further, the options for selecting selectable print line widths are not limited to the above examples.

Figure 15A:
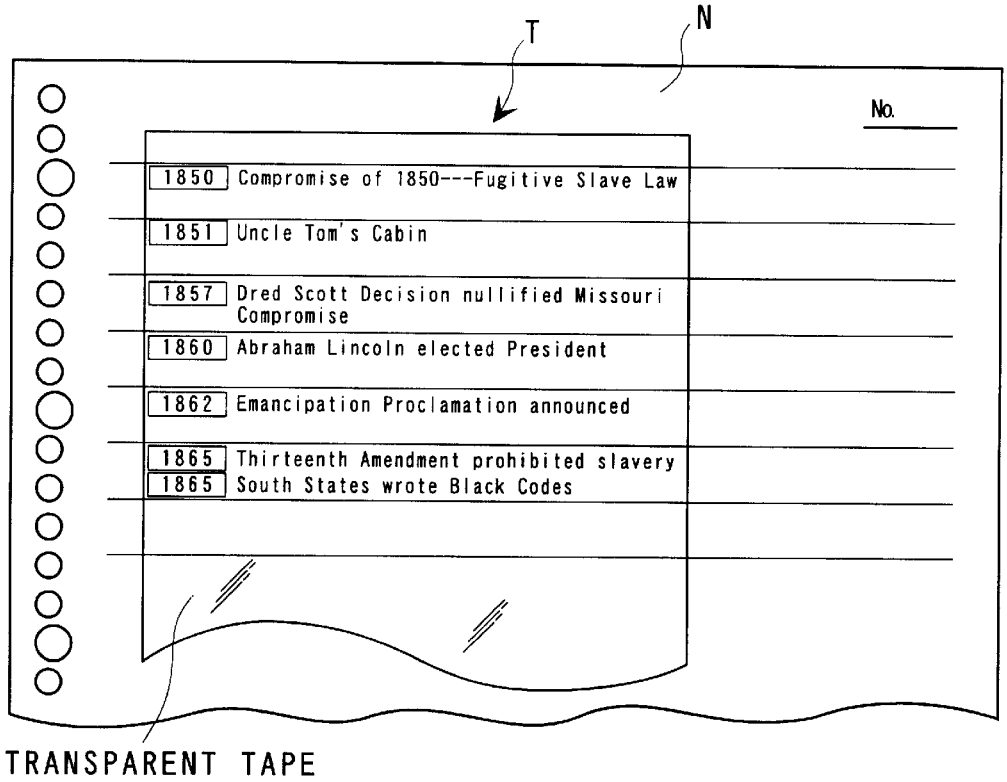
FIGS. 15A and 15B are diagrams showing still other applications of prints obtained by the same.
Figure 15B:
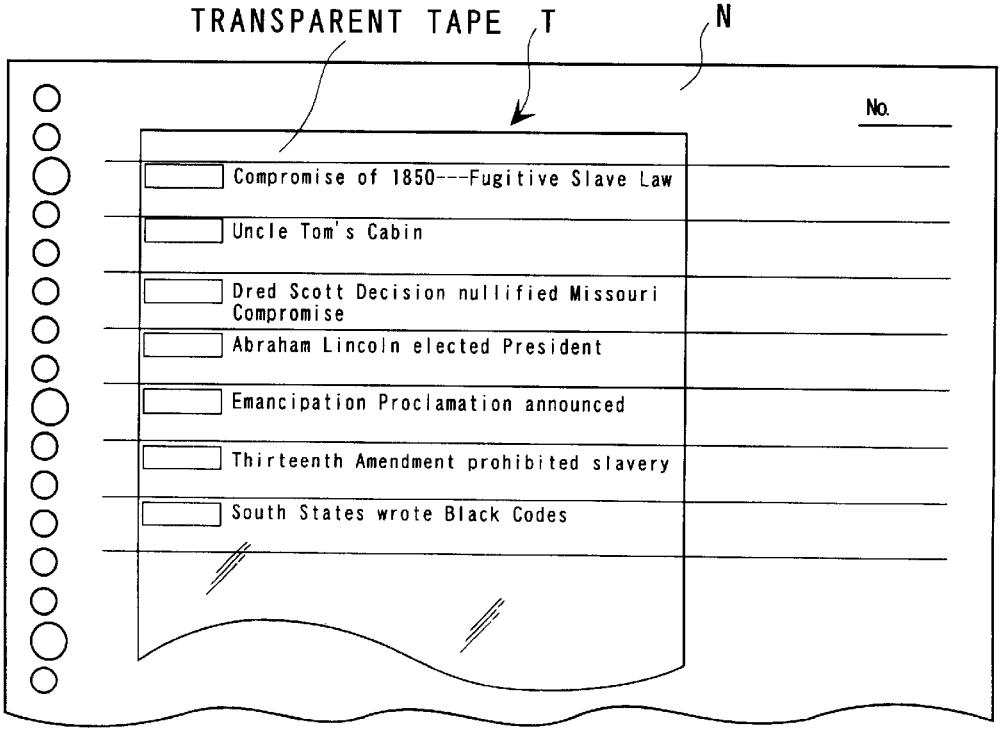

Now, if the option ½ is selected, the print line width is set such that the one ruled line spacing on the object article N and the width of two print lines of the tape T are the same size (see FIGS. 15A and 15B). As described above, the vertical size of a character or the lateral size thereof is designated to be enlarged on a ruled line spacing-by-ruled line spacing basis, whereby it is possible for the user to easily imagine the size of characters to be printed, and eliminate mismatching between the ruled line spacing of the object article N and the print line width on the tape T, which results in attractive appearance of the object article N with the tape T affixed thereto.

In the above case, it is preferred that the character size is determined such that the characters are laid out with appropriate space (interlinear spacing defined as a spacing between adjacent concatenations of character bodies in a direction perpendicular to a direction of extension of character strings) with respect to the designated ruled line spacing between adjacent ruled lines. This configuration makes it possible to eliminate inconveniences e.g. of partial overlapping of letters due to narrow interlinear spacing which makes it difficult to read the letters.

In the illustrated example, on the ruled line spacing multiplier selection screen (D46), the print key is depressed by the user in the state of the option 1 set by default being displayed in reverse video, whereby the screen 41 is switched to a printing execution screen (D47). On this screen, letters "PRNT EXE" indicating that printing is being carried out are displayed, at first together with letters "PREPARING" which are temporarily displayed in half-tone dot meshing. After the printing operation has been completed in a several seconds, the tape T is cut off at an appropriate position thereof, and as shown in FIGS. 11A and 11B, a print (tape T) having a list of data printed thereon is produced (details of the settings (selected options) are as follows: print range: DATA1+3; discriminative data: DATA3 (committees to which persons belong); criterion: ENTERED; direction of printing: PRTRT/HRZNTL (portrait/horizontal writing); corresponding sheet size: SIZE1 (A4); corresponding ruled line spacing: 7 mm (A); and multiplier: 1). Further, upon completion of the printing operation, the screen 41 returns (is switched) to the "G02 selection screen" (D48: the same as D36 in FIG. 7).

Figure 11C:
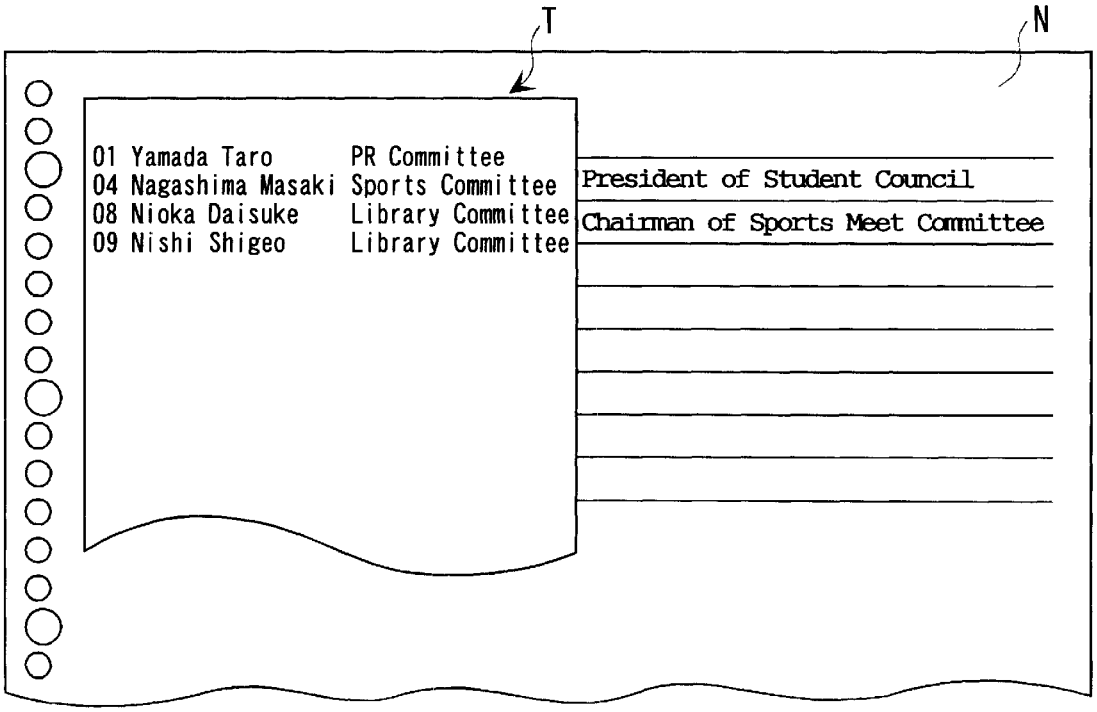

As shown in FIG. 11C, the printed tape T has the adhesive layer Tc on the reverse side thereof peeled off and is affixed to the object article N. At this time, it is preferable to affix the tape while paying attention to upward and downward directions thereof such that characters printed on the tape T are properly arranged between ruled lines when the object article N is seen through the tape T. Thus, the object article N can have an excellent appearance when it has the tape T affixed thereto.

Further as shown in the figure, when notes or memos are entered to comment on data printed on the print medium as well, the characters can be prevented from being written across the ruled lines on the notebook since the print line width on the print medium and the ruled line spacing on his notebook match each other. This enables the user to make the contents of the notebook orderly and attractive.

Figure 12A:
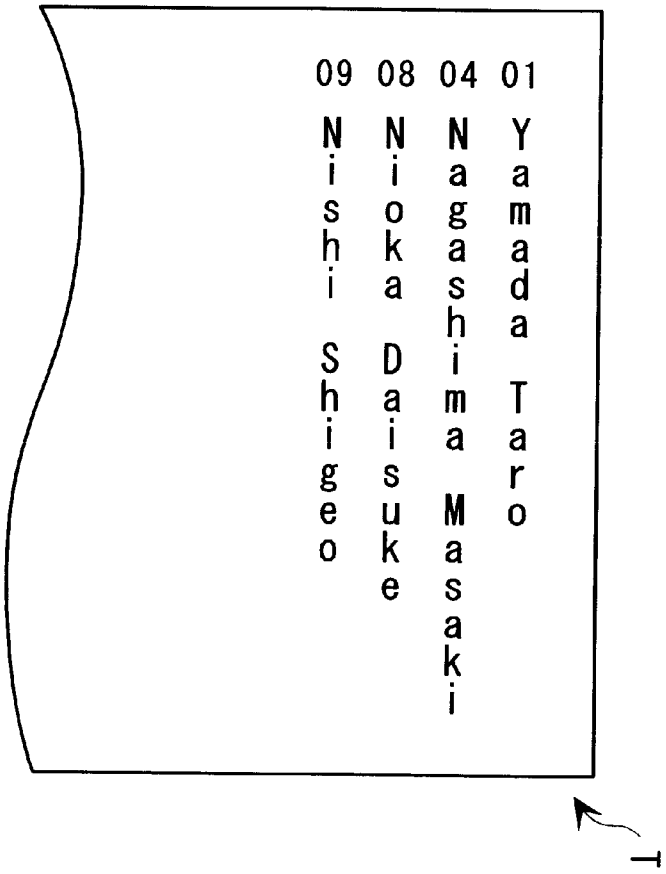
FIGS. 12A and 12B are diagrams showing other examples of the print.
Figure 12B:
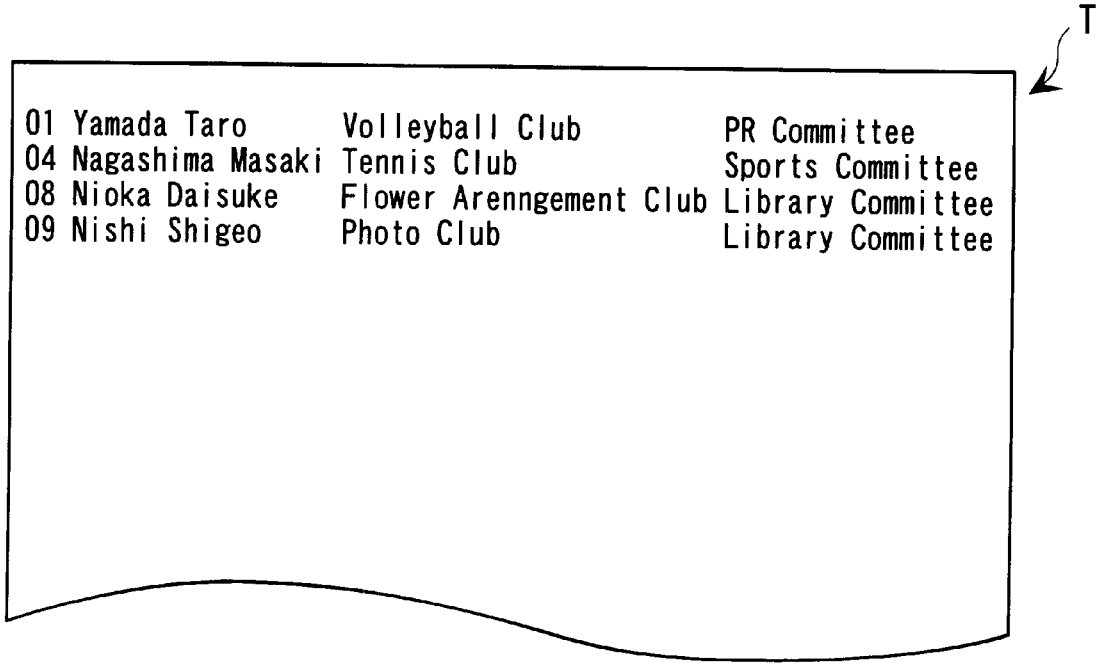

In the above printing operations, for instance, on the printing direction selection screen (D43 in FIG. 9), when the option "LNDSCP/VRTCL" is selected, a print as shown in FIG. 12A is obtained. Further, when the option "ALL" is selected on the "G02 selection screen" (D36 in FIG. 7), a print as shown in FIG. 12B is obtained. In this case, it is preferred that the width of the tape T is detected by the tape-discriminating sensor 142, and a character size is determined depending on the tape width.

Figure 13A:
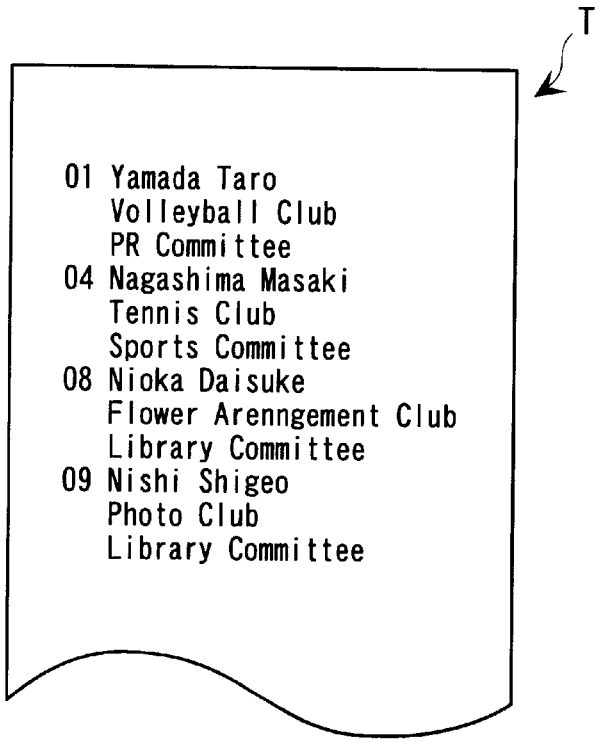
FIGS. 13A and 13B are diagrams showing applications of prints obtained by the printing method according to the present invention.
Figure 13B:
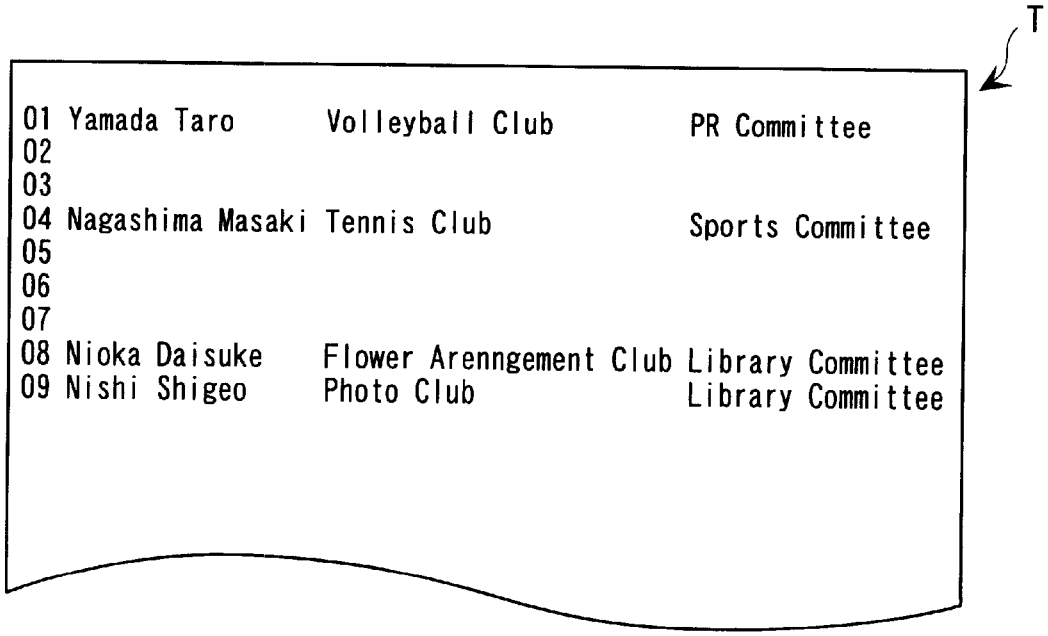

As an applied form of the present embodiment, the DATA 1 to DATA 3 may be laid out not in the manner written side by side in the lateral direction (see FIG. 12B) but in a manner written side by side in the vertical direction, as shown in FIG. 13A. Further, as shown in FIG. 13B, in the case of an entry number which does not have a data item entered to the DATA 3, only the entry number may be printed with the field for entering the data being left blank.

Figure 14A:
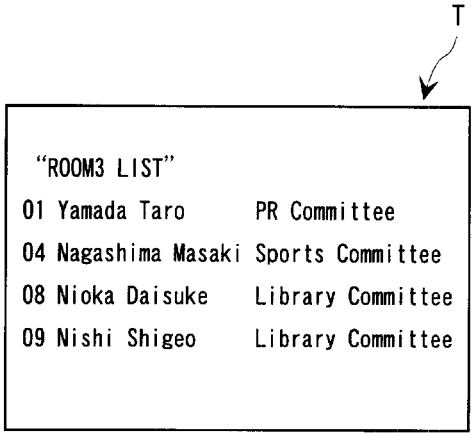
FIGS. 14A to 14D are diagrams showing other applications of prints obtained by the same.
Figure 14B:
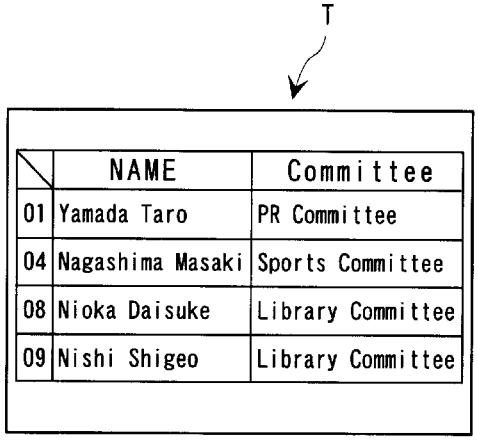

As shown in FIG. 14A, the registered or entered group name (see D14 and D15 in FIG. 4) may be printed as the title of a list of print data items. Further, as shown in FIG. 14B, the list of the print data may be printed in the form of a table by drawing straight lines for rows and columns therein. In this case, it is preferred that each data item can be entered under a title or classification thereof (e.g. "NAME" and "COMMITTEE") so as to allow them to be printed. This configuration makes it possible to produce a table which facilitates viewing and understanding details of the print data.

Figure 14C:
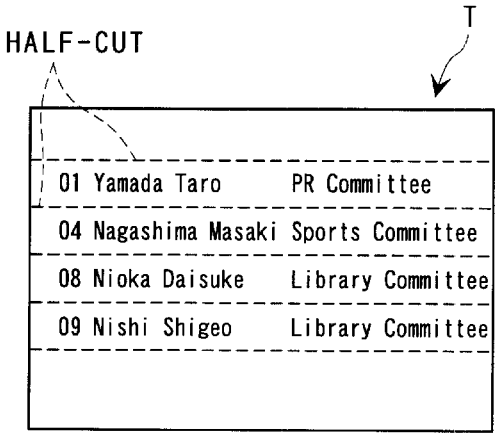
Figure 14D:
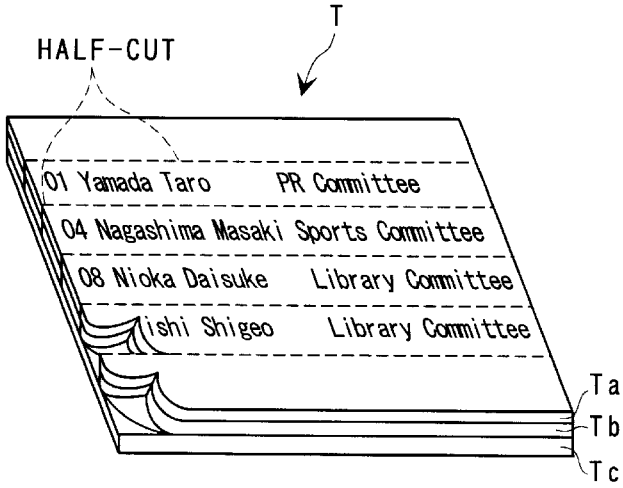

Further, as shown in FIGS. 14C and 14D, the tape T may be subjected to half-cutting on a row-by-row basis (indicated by dotted lines in the figures) to cut off each print line for affixation to the object article N.

Further, as shown in FIG. 15A, if years and details of historical events which happened in the years are recorded as data in advance, it is possible to create a chronological table. In this case, it is preferred that the chronological table is constructed such that if the years are registered as "DATA 1", the details of the "DATA 1" can be printed as they are (see FIG. 15A), or alternatively the "DATA 1" can be printed as blank images (see FIG. 15B). Further, as described hereinabove, when the width of two print lines on the tape T and the one ruled line spacing on the object article N are set to have the same size, the apparatus may be configured such that the user can select either a method of printing two print lines within the one ruled line spacing, as shown in FIG. 15A, or a method of printing one event in the one ruled line spacing, as shown in FIG. 15B (if one event can be printed in one print line, the other print line is left blank).

Further, as shown in FIGS. 15A and 15B, if a transparent tape is employed as a print medium, the ruled lines on the object article N can be seen through the transparent tape, and hence it is possible to exploit the ruled lines as they are and make the print medium affixed to the object article N inconspicuous.

Figure 16:
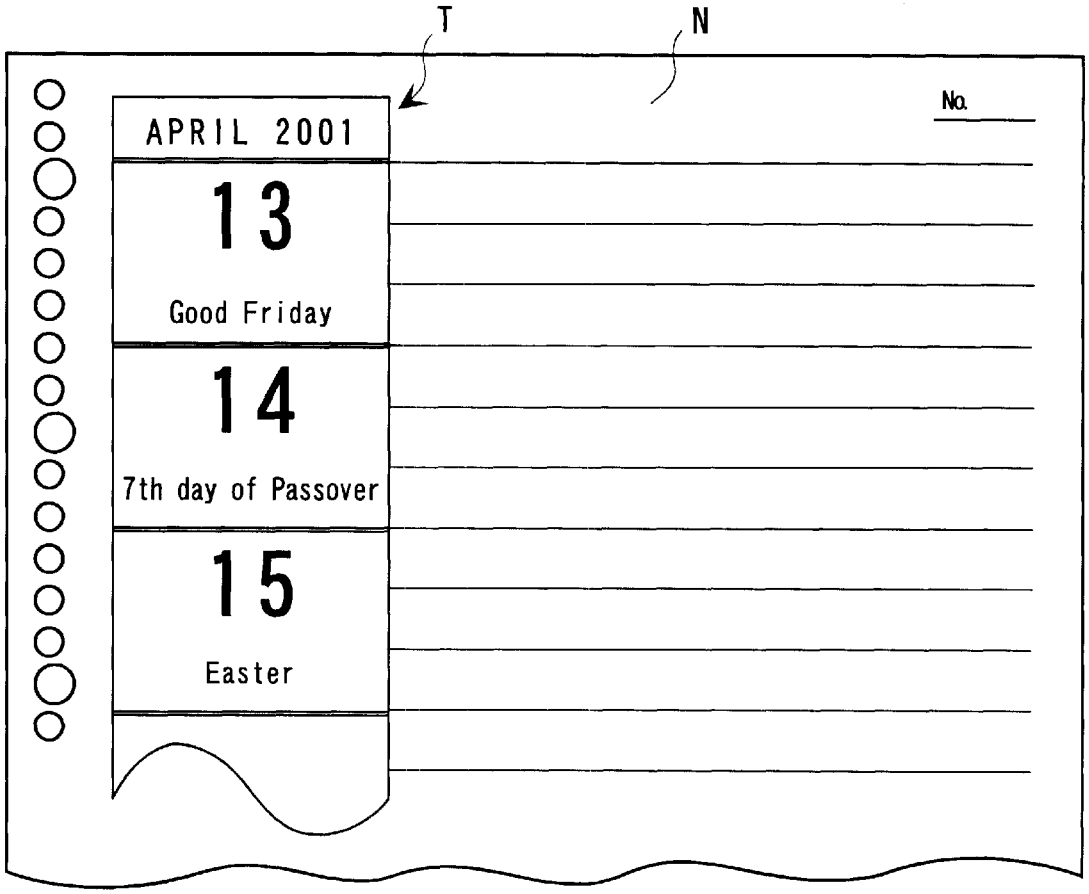
FIG. 16 is a diagram showing still another application of a print obtained by the same.

Further, if the apparatus is configured such that letter sizes can be changed on a data-by-data basis, and at the same time the direction in which data items are written side by side can be selected, it is also possible to produce a tape T as shown in FIG. 16. In this method, first, letters and numerals "APRIL 2001" are entered to the group name, a number "13" is entered to the "DATA 1" under the entry number 01, letters "Good Friday" are entered to the "DATA 2" under the entry number 01, a number "14" is entered to the "DATA 1" under the entry number 02, and letters "7th day of Passover" are entered to the DATA 2" under the entry number 02. Still further, the sizes of the "DATA 1" and the "DATA 2" are set to respective sizes corresponding to the two ruled line spacings and one ruled line spacing, and a direction in which data items are written side by side is set to a vertical direction (see FIG. 13A). Then, if a corresponding sheet size and a corresponding ruled line spacing are set in a manner adapted to the object article N, and the multiplier of 1 (the width of one print line on the tape T has the same size as that of one ruled line spacing on the object article N) is set on the ruled line spacing multiplier selection screen, the tape T thus produced can be employed as a "diary label" shown in FIG. 16.

In the above case, it is preferred that the tape T is configured to be cut through not at intermediate portions of blocks formed in units of a day but at cutting lines (thick line portions) along boundaries between the blocks. The printing apparatus according to the present invention may be connected to an external storage device which has stored the above data items to thereby input the data items to the printing apparatus. This construction makes it possible to save the trouble of registering data to produce a "diary label" with ease.

As described hereinabove, according to the tape printing apparatus 1 and printing method according to the invention, the print line width printed on the tape T is set in a manner adapted to a ruled line spacing defined by a predetermined standard, and characters are printed on the tape T based on the print line width thus set or determined. Hence, when the tape T printed with the characters is affixed to the object article N having ruled lines, the print line width on the tape T and the ruled line spacing on the object article N match each other, whereby the object article N can have an attractive appearance after the tape T is affixed thereto. Further, since data to be printed are grouped and stored, only a group required can be designated to print only character data belonging to the group. Further, desired discriminative data in the group can be designated to print only character data corresponding to the discriminative data. In short, it is possible to produce a print which can make the object article N attractive in appearance when the print is affixed to an object article and have a print image meeting the user's needs.

Although in the above embodiment, it is assumed that data is discriminated or selected only in one group (i.e. in the "G02" in the above-described embodiment), this is not limitative, but a plurality of groups of data to be printed may be selected to thereby print data items corresponding to designated discriminative data out of all the data entered to the plurality of groups. In this case, it is preferred that individual character data are grouped by adding thereto "discriminative data" varying from one group to another. According to this construction, character data in a group for printing may be identified simply by ignoring the "discriminative data" added thereto, which contributes to facilitating control of the character data.

Although in the above embodiment, corresponding sizes and corresponding ruled lines are selected from options on display screens of the screen 41 different from each other, this is not limitative, but they may be selected from a plurality of options formed by combining the above options on one display screen (for instance, "SIZE1 (7 mm)", "SIZE3 (7 mm)", "SIZE1 (6 mm)", and so forth).

Although in the above embodiment, letter sizes (character sizes) are designated in units of a line width on the tape T, they may be designated by entering a numerical value (point number) as conventionally known. In this case, however, when the vertical or lateral size of characters is k times (k represents a number truncated to an integer by dropping a fractional portion of the number below a decimal point) as large as the ruled line spacing defined by the predetermined standard, it is preferable to set the number of print lines occupied by the characters to (k+1).

According to the above construction, it is possible to set the number of print lines occupied by the characters such that the designated vertical or lateral size of the characters can be printed within an integral multiple of the one ruled line spacing, so that to whatever size the characters may be set, it is possible to affix the tape T to the object article N without mismatching, whereby the object article with the tape T affixed thereto can have an attractive appearance.

In the above case, it is preferred that a remaining length as a result of subtraction of the vertical or lateral size of a character from product of the one ruled line spacing multiplied by (k+1) is allocated to upper and lower portions of interlinear spacing such that the upper and lower portions have an equal width. According to this configuration, the object article can have a more attractive appearance after the tape T is affixed to the same.

Further, it is preferred that assuming that straight lines with reference to which the character strings are arranged in a direction of length of print lines and which extend in parallel with the direction of length of print lines are defined as reference lines, with a distance between adjacent ones of the reference lines being represented by a and the ruled line spacing defined by the predetermined standard being represented b, the character size designation means includes means for designating the size of the character such that a value of a×m (m is an integer equal to or larger than 1) and a value of b×n (n is an integer equal to or larger than 1) are equal to each other.

Figure 18A:
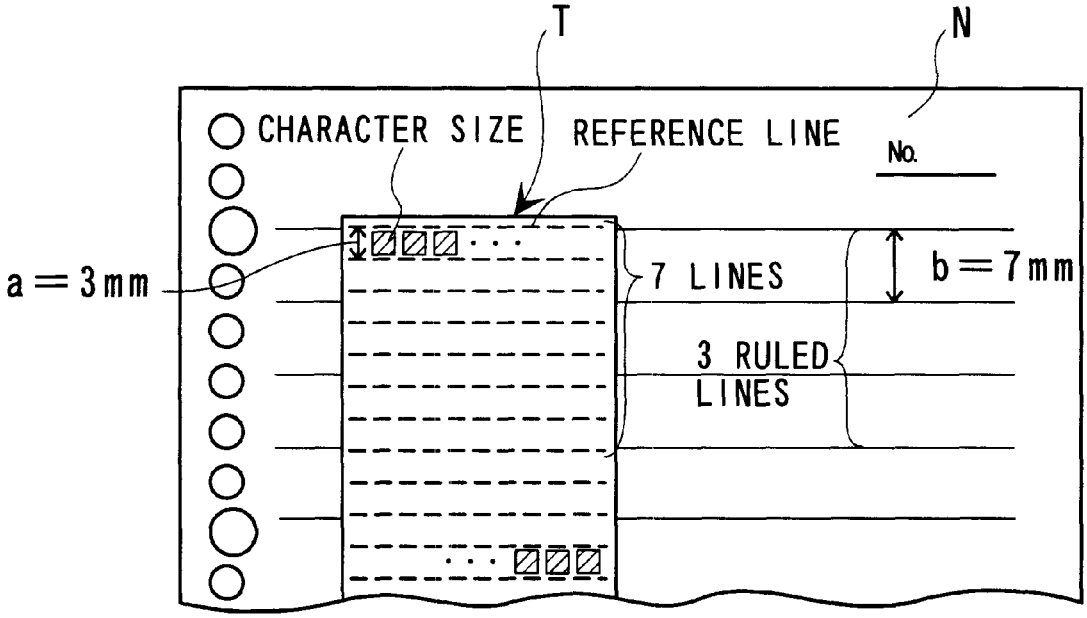
FIGS. 18A and 18B are diagrams showing applications of prints other than those mentioned above which are obtained by the printing method according to the present invention.
Figure 18B:
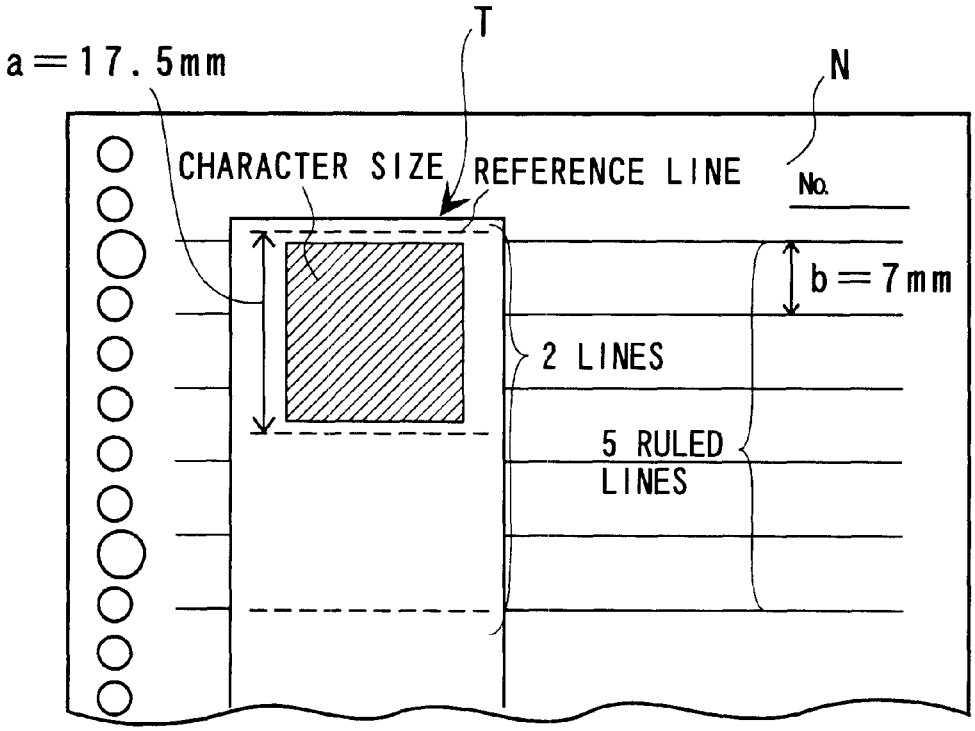
Figure 19:
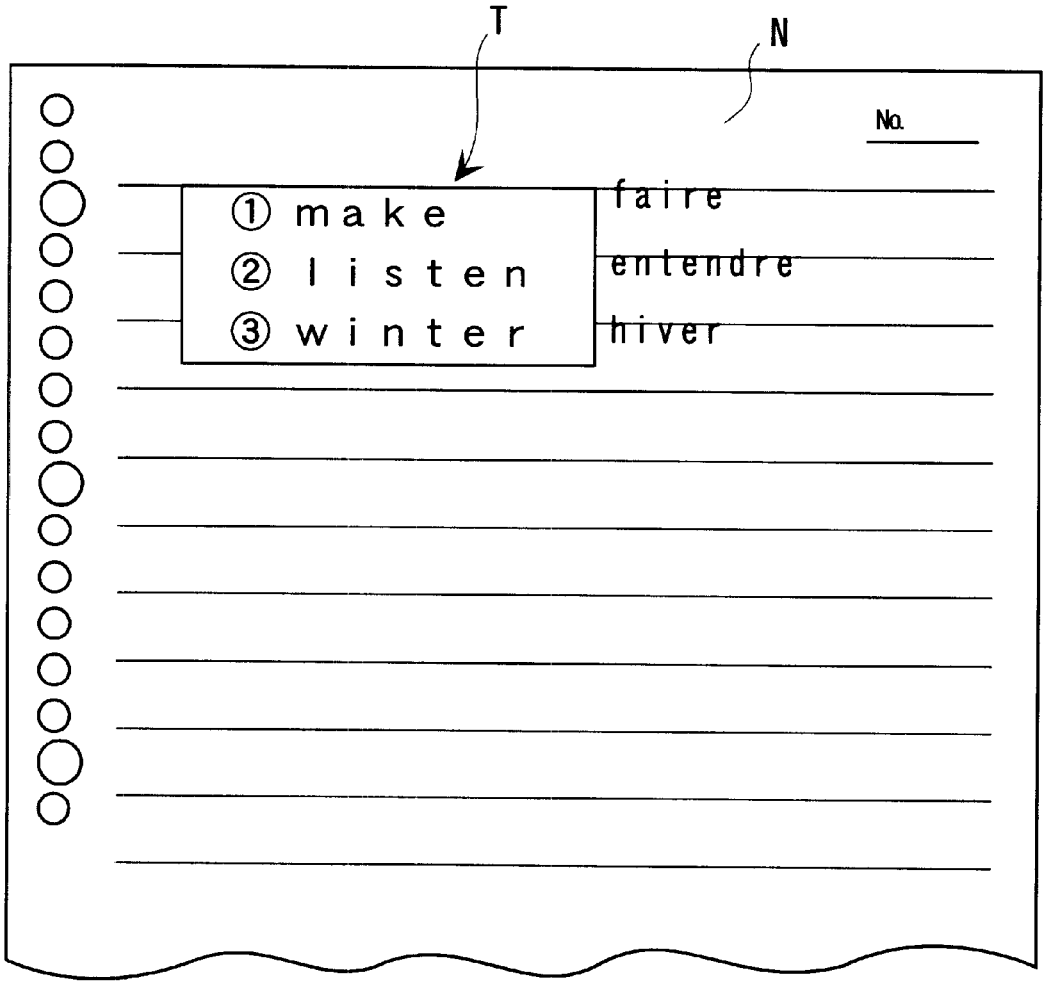
FIG. 19 is a diagram useful in explaining the prior art.

For instance, as shown in FIG. 18A, if the distance a between the reference lines is equal to 3 mm, and the size b of the one ruled line spacing is equal to 7 mm, the common multiples of the distance a and the size b are 21, 42, . . . . In the case of 21 as one of the values thus obtained, for instance, (the case in which the product of a×m and that of b×n are equal to 21), the value of m and the value of n are equal to 7 and 3, respectively. This means that it is possible to designate a character size such that seven rows of character strings can be printed within the three ruled line spacings. Inversely, as shown in FIG. 18B, if two rows of character strings are designated to be printed within the five ruled line spacings with the one ruled line spacing being equal to 7 mm, it is possible to designate a character size such that the distance a between the reference lines is equal to 17.5 mm (a=b×5/2). That is, according to this construction, out of the distance between reference lines, the ruled line spacing, the number of lines, and the number of ruled line spacings (multiplier), by designating two or more of them, the values or candidates of the values of the other parameters can be extracted. Therefore, this makes it possible to minimize mismatching between the ruled line spacing and the print line width as well as freely set the size of characters, thereby enhancing the appearance of the object article with the print affixed thereto.

It should be noted that in the above case, it is preferred that the character size is determined such that the characters are laid out with appropriate space (interlinear spacing defined as a spacing between adjacent concatenations of character bodies in a direction perpendicular to a direction of extension of character strings) with respect to the distance a between the reference lines. This configuration makes it possible to eliminate inconveniences e.g. that it becomes difficult to read letters when they are printed with narrow interlinear spacing.

Further, data items may be laid out such that the order of printing them can be changed in accordance with a predetermined order rule. For instance, in the above embodiment, when the predetermined order rule is alphabetical order, the names of a plurality of students can be rearranged in alphabetical order for printing (Hara→Kawai→Suzuki→Moto→Nagashima→Nishi→Yamada: original order of registered data is shown in FIG. 10B). In short, a plurality of character data stored at random can be printed in a order desired by the user.

It is further understood by those skilled in the art that the foregoing is a preferred embodiment of the invention, and that various changes and modifications may be made without departing from the spirit and scope thereof.

What is claimed is:

1. A printing apparatus which is capable of printing characters of a desired size on a print medium while feeding the print medium contained therein, the printing apparatus comprising:

print line width-setting means for setting a print line width such that the print line width is adapted to a ruled line spacing defined by a predetermined standard; and printing means for printing the characters in the print line width set by said print line width-setting means.

2. A printing apparatus according to claim 1, wherein said print line width-setting means includes means for setting the print line width not by designating a numerical value but by designating a type of the ruled line spacing defined by the predetermined standard.

3. A printing apparatus according to claim 1, wherein said print line width-setting means includes means for designating a size of one print line width as an integral multiple of one ruled line spacing defined by the predetermined standard.

4. A printing apparatus according to claim 1, further comprising printing direction-setting means for setting a direction of printing of the characters and a direction of length of print lines of the characters.

5. A printing apparatus according to claim 4, wherein said printing direction-setting means includes means for setting the direction of printing such that an upward direction with respect to the characters coincides with a direction of feed of the print medium, and at the same time the direction of length of print lines is orthogonal to the direction of feed of the print medium.

6. A printing apparatus according to claim 4, wherein said printing direction-setting means includes means for setting the direction of printing such that an upward direction with respect to the characters and the direction of length of print lines are orthogonal to the direction of feed of the print medium.

7. A printing apparatus according to claim 1, further comprising character size designation means for designating a size of one character.

8. A printing apparatus according to claim 7, wherein assuming that straight lines with reference to which the character strings are arranged in a direction of length of print lines and which extend in parallel with the direction of length of print lines are defined as reference lines, with a distance between adjacent ones of the reference lines being represented by a and the ruled line spacing defined by the predetermined standard being represented b, said character size designation means includes means for designating the size of the character such that a value of a×m (m is an integer equal to or larger than 1) and a value of b×n (n is an integer equal to or larger than 1) are equal to each other.

9. A printing apparatus according to claim 7, wherein assuming that either a vertical size or a lateral size of the character designated by the character size designation means is k times (k is a number truncated to an integer) as large as the ruled line spacing defined by the predetermined standard, said print line width-setting means includes means for setting a number of lines occupied by the characters to (k+1).

10. A printing apparatus according to claim 1, further comprising storage means for storing a plurality of character data converted from the characters and storing grouping data for classifying the plurality of character data into at least one group, and group selection means for selecting one group from the at least one group, and wherein said printing means prints characters corresponding to the plurality of character data belonging to the one group selected by said group selection means.

11. A printing apparatus according to claim 10, further comprising printing order-changing means for changing an order of printing of the plurality of character data according to a predetermined order rule, and wherein said printing means prints characters according to the order of printing changed by said printing order-changing means.

12. A printing apparatus according to claim 10, wherein said storage means further includes means for storing discriminative data for discriminating between the plurality of character data in a manner correlating the discriminative data with each of the character data, and wherein said printing means determines for each of the character data whether or not characters corresponding thereto should be printed, depending on details of or presence or absence of the discriminative data correlated with each of the character data.

13. A printing apparatus according to claim 12, further comprising input means capable of inputting at least one of the character data, the grouping data and the discriminative data, wherein the data input by the input means are stored in the storage means.

14. A printing apparatus according to claim 1, wherein the printing means includes means for printing the plurality of character data in a list form.

15. A printing apparatus according to claim 1, wherein the print medium is formed by an image-receiving layer serving as a printing surface, an adhesive layer formed on a side reverse thereto, and a peel layer formed on the adhesive layer, the print medium being affixable to an object article by peeling off the image-receiving layer and the adhesive layer from the peel layer.

16. A printing apparatus according to claim 15, further comprising cutting means for cutting off the print medium to a desired size, and object article size-designating means for designating a size of the object article to which the print medium is affixed, and wherein said cutting means cuts off the print medium to a size permitting the print medium to be affixed to the size designated by said object article size-designating means.

17. A printing apparatus according to claim 15, wherein the print medium is made of a material having high transparency.

18. A printing apparatus according to claim 1, wherein the print medium is a tape-shaped member.

* * * * *